US008583443B2

(12) United States Patent
Misawa

(10) Patent No.: US 8,583,443 B2
(45) Date of Patent: Nov. 12, 2013

(54) RECORDING AND REPRODUCING APPARATUS

(75) Inventor: Masayuki Misawa, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 1000 days.

(21) Appl. No.: 12/100,760

(22) Filed: Apr. 10, 2008

(65) Prior Publication Data

US 2008/0255853 A1 Oct. 16, 2008

(30) Foreign Application Priority Data

Apr. 13, 2007 (JP) ..... 2007-106351

(51) Int. Cl.
*G10L 21/00* (2013.01)

(52) U.S. Cl.
USPC ..... 704/278; 704/200; 704/200.1; 704/205; 704/207; 704/246; 704/258; 704/260; 704/268; 704/270; 704/9; 725/109; 340/12.22; 379/88.14; 379/88.18; 381/77; 455/563; 607/57; 701/211

(58) Field of Classification Search
USPC ..... 704/9, 260, 200, 200.1, 205, 207, 246, 704/258, 268, 270; 701/211; 379/88.18, 379/88.14; 3/9, 260; 340/12.22; 381/77; 455/563; 607/57; 725/109
See application file for complete search history.

(56) References Cited

U.S. PATENT DOCUMENTS 5,230,037 A * 7/1993 Giustiniani et al. ..... 704/200
5,845,047 A * 12/1998 Fukada et al. ..... 704/268
5,873,059 A * 2/1999 Iijima et al. ..... 704/207
5,899,966 A * 5/1999 Matsumoto et al. ..... 704/205
5,911,128 A * 6/1999 DeJaco ..... 704/200.1
6,161,091 A * 12/2000 Akamine et al. ..... 704/258
6,216,104 B1 * 4/2001 Moshfeghi et al. ..... 704/260
6,246,976 B1 * 6/2001 Mukaigawa et al. ..... 704/9
6,256,609 B1 * 7/2001 Byrnes et al. ..... 704/246
6,519,479 B1 * 2/2003 Garudadri et al. ..... 455/563
7,327,834 B1 * 2/2008 Hiers et al. ..... 379/88.18
7,818,066 B1 * 10/2010 Palmer ..... 607/57
8,254,533 B2 * 8/2012 Johnston et al. ..... 379/88.14
2002/0049535 A1 * 4/2002 Rigo et al. ..... 701/211
2002/0138273 A1 * 9/2002 Raman et al. ..... 704/270
2003/0014252 A1 * 1/2003 Shizuka et al. ..... 704/258
2003/0112149 A1 * 6/2003 Jarvors ..... 340/825.72
2003/0138113 A1 * 7/2003 Han ..... 381/77
2004/0243398 A1 12/2004 Yamada
2005/0043940 A1 * 2/2005 Elder ..... 704/9
2005/0119890 A1 * 6/2005 Hirose ..... 704/260
2005/0240976 A1 * 10/2005 Kim ..... 725/109

FOREIGN PATENT DOCUMENTS

JP 2004-354921 A 12/2004

* cited by examiner

*Primary Examiner* — Michael Colucci
(74) *Attorney, Agent, or Firm* — Crowell & Moring LLP

(57) ABSTRACT

Disclosed is a recording and reproducing apparatus comprising: an apparatus main body; and a remote controller to perform remote control of the apparatus main body, wherein the remote controller comprises: a key operating section to receive a key operation by a user; a sound information inputting section to input sound information; and a transmitting section to transmit sound data based on the sound information to the apparatus main body, and the apparatus main body comprises: a recording section to record input content data on a recording medium; a reproducing section to reproduce the content data; a receiving section to receive the sound data; a sound information recording section to record the sound data so as to be associated with a piece of the content data; and a sound information outputting section to reproduce the sound data to output the reproduced sound data.

11 Claims, 15 Drawing Sheets

FIG. 13

TITLE LIST

| No. | TITLE | BROADCASTING STATION | BROADCASTING DATE | CH |
|---|---|---|---|---|
| 171 | A, B, C, D, E | B TELEVISION | 10/17 (MON.) | 041 |
| 172 | A, B, C, D, E | B TELEVISION | 10/18 (TUES.) | 041 |
| 173 | A, B, C, D, E | B TELEVISION | 10/19 (WED.) | 041 |
| 174 | A, B, C, D, E | B TELEVISION | 10/20 (THUR.) | 041 |
| 175 | A, B, C, D, E | B TELEVISION | 10/21 (FRI.) | 041 |
| 176 | A, B, C, D, E | B TELEVISION | 10/24 (MON.) | 041 |
| 177 | A, B, C, D, E | B TELEVISION | 10/25 (TUES.) | 041 |

SELECT ▲/▼ DECIDE ▢ RETURN ↵

RECORDING AND REPRODUCING APPARATUS

BACKGROUND OF THE INVENTION

1. Field of the Invention

The present invention relates to a recording and reproducing apparatus capable of recording and reproducing content data.

2. Description of Related Art

A recording and reproducing apparatus, such as a hard disc drive (HDD) recorder, which performs the recording and the reproducing of content data, generally adopts the method of selecting a desired piece of content in a title list displayed on a display at the time of selecting a piece of reproducing content among the pieces of recorded content.

FIG. 13 is a view illustrating a title list to be displayed on a display at the time of selecting a piece of reproducing content in a conventional recording and reproducing apparatus. As shown in FIG. 13, for example, the program information (that is, the title, the broadcasting station, the broadcasting date and time, the channel, and the like) of each piece of recorded content is displayed in a list in the conventional title list. A user selects a desired piece of content in the list of these pieces of program information.

However, there are problems of the difficulty of judging the content of a program only by the program information, such as the title, displayed in the title list of FIG. 13, and of the difficulty of easily selecting a desired piece of reproducing content. In particular, when a series of programs having the same title is recorded, it is very difficult to judge the content of each of the programs only by the recording date and time thereof.

The method of editing the program title of recorded content with a remote controller, a keyboard connected to the apparatus main body, and the like, is known accordingly. However, this method requires superfluous trouble for the editing operation, and the editing operation itself is troublesome. Consequently the method has a problem for a user to be inconvenient.

In addition, there are known methods, such as the method of displaying the opening screen of content as a thumbnail image, the method of reproducing the digest of content in a thumbnail screen, the method of extracting a part by which the content of a program can be judged from recorded content to reproduce the part, and the like. However, these methods of performing preview reproduction take time for performing the reproduction of content to judge the content, and consequently these methods are inconvenient.

Accordingly, Japanese Patent Application Laid-Open Publication No. 2004-354921 discloses a sound recording and reproducing apparatus to enable a user to know the recorded content of the main sound easily by inputting a title or a memorandum to indicate the content of the main sound by a sound, and by recording the title or the memorandum onto a recording medium with the title or the memorandum associated with the main sound to reproduce the recorded title or the memorandum.

However, because the technique disclosed in the Japanese Patent Application Laid-Open Publication No. 2004-354921 cannot input the sound memorandum into the apparatus main body by remote control, the technique has the problem of the remaining inconvenience for a user.

SUMMARY OF THE INVENTION

It is an object of the present invention to provide a recording and reproducing apparatus to enable a user to input sound information related to recorded content by a simpler method by remote control using a remote controller.

According to a first aspect of the present invention, there is provided a recording and reproducing apparatus comprising:

an apparatus main body; and a remote controller to perform remote control of the apparatus main body, wherein the remote controller comprises:

a key operating section to receive a key operation by a user;

a sound information inputting section to allow the user to input sound information; and a transmitting section to transmit sound data to the apparatus main body, the sound data being based on the sound information input by the sound information inputting section, and the apparatus main body comprises:

a recording section to record input content data on a recording medium;

a reproducing section to reproduce the content data recorded on the recording medium by the recording section;

a receiving section to receive the sound data transmitted from the remote controller by the transmitting section;

a sound information recording section to record the sound data so as to be associated with a piece of the content data, the sound data being received by the receiving section;

a conversion-to-sound section to convert the sound data into predetermined sound data, the sound data being recorded by the sound information recording section;

a converted sound outputting section to output a sound based on the predetermined sound data converted by the conversion-to-sound section;

a selecting section to select a conversion-to-sound mode of the predetermined sound data, among a plurality of conversion-to-sound modes based on the key operation in the key operating section, the predetermined sound data being converted by the conversion-to-sound section;

a retrieving section to retrieve sound data which includes a predetermined word and phrase among the sound data based on the key operation in the key operating section, the sound data being recorded by the sound information recording section; and a display controlling section to make a displaying section display information pertaining to the content data associated with the sound data which includes the predetermined word and phrase, the sound data being retrieved by the retrieving section.

According to a second aspect of the present invention, there is provided a recording and reproducing apparatus comprising:

an apparatus main body; and a remote controller to perform remote control of the apparatus main body, wherein the remote controller comprises:

a key operating section to receive a key operation by a user;

a sound information inputting section to allow the user to input sound information; and a transmitting section to transmit sound data to the apparatus main body, the sound data being based on the sound information input by the sound information inputting section, and the apparatus main body comprises:

a recording section to record input content data on a recording medium;

a reproducing section to reproduce the content data recorded on the recording medium by the recording section;

a receiving section to receive the sound data transmitted from the remote controller by the transmitting section;

a sound information recording section to record the sound data so as to be associated with a piece of the content data, the sound data being received by the receiving section; and a sound information outputting section to reproduce the sound data recorded by the sound information recording section, to output the reproduced sound data.

According to a third aspect of the present invention, there is provided a recording and reproducing apparatus comprising:

an apparatus main body; and a remote controller to perform remote control of the apparatus main body, wherein the remote controller comprises:

a key operating section to receive a key operation by a user;

a sound information inputting section to allow the user to input sound information; and a transmitting section to transmit sound data to the apparatus main body, the sound data being based on the sound information input by the sound information inputting section, and the apparatus main body comprises:

a recording section to record input content data on a recording medium;

a reproducing section to reproduce the content data recorded on the recording medium by the recording section;

a receiving section to receive the sound data transmitted from the remote controller by the transmitting section;

a sound information recording section to record the sound data so as to be associated with a piece of the content data, the sound data being received by the receiving section;

a conversion-to-sound section to convert the sound data into predetermined sound data, the sound data being recorded by the sound information recording section; and a converted sound outputting section to output a sound based on the predetermined sound data converted by the conversion-to-sound section.

According to a fourth aspect of the present invention, there is provided a recording and reproducing apparatus comprising:

an apparatus main body; and a remote controller to perform remote control of the apparatus main body, wherein the remote controller comprises:

a key operating section to receive a key operation by a user;

a sound information inputting section to allow the user to input sound information; and a transmitting section to transmit sound data to the apparatus main body, the sound data being based on the sound information input by the sound information inputting section, and the apparatus main body comprises:

a recording section to record input content data on a recording medium;

a reproducing section to reproduce the content data recorded on the recording medium by the recording section;

a receiving section to receive the sound data transmitted from the remote controller by the transmitting section;

a conversion-to-text section to convert the sound data into text data, the sound data being received by the receiving section;

a text recording section to record the text data so as to be associated with a piece of the content data, the text data being converted by the conversion-to-text section;

a conversion-to-sound section to convert the text data into predetermined sound data, the text data being recorded by the text recording section; and a converted sound outputting section to output a sound based on the predetermined sound data converted by the conversion-to-sound section.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 13 is a view illustrating a title list displayed on a display at the time of selecting a piece of reproducing content and the like in a conventional recording and reproducing apparatus.

DESCRIPTION OF THE PREFERRED EMBODIMENTS

In the following, the preferred embodiments of the present invention will be described in detail with reference to the drawings.

(First Embodiment)

In a first embodiment, descriptions are given to an exemplified hard disc drive (HDD) (fixed magnetic disk drive) recorder to perform recording to a magnetic disk as a recording and reproducing apparatus.

Figure 1:
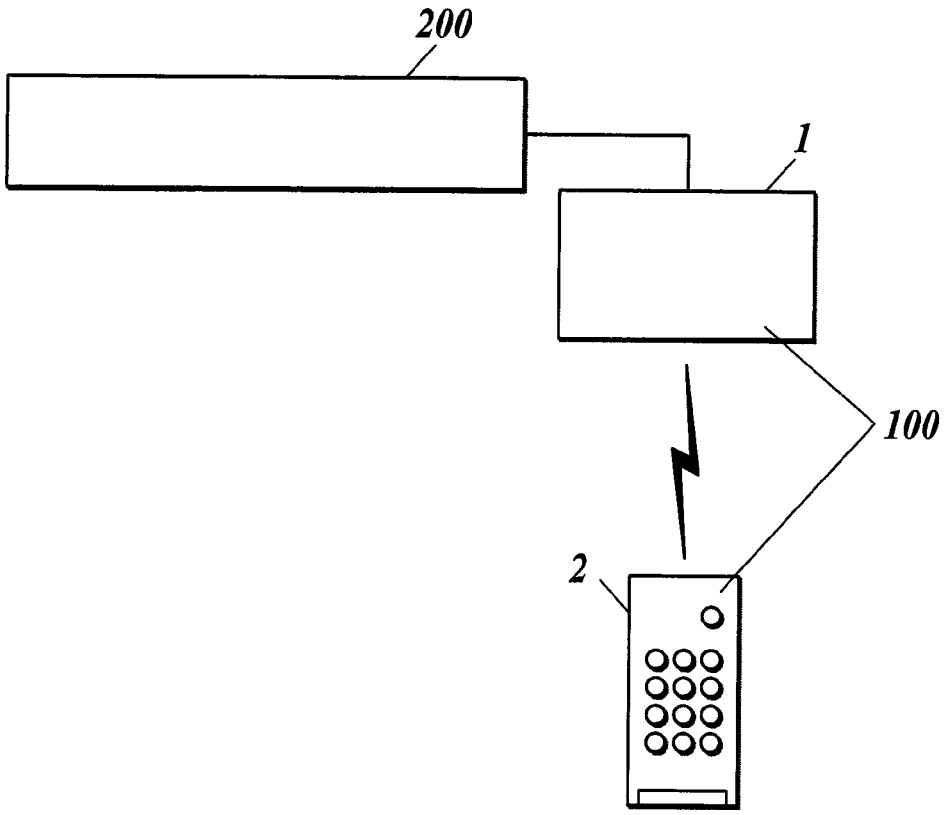
FIG. 1 is a view showing the whole configuration of an HDD recorder according to a first embodiment.

AN HDD recorder 100 of the first embodiment comprises an apparatus main body 1 and a remote controller 2 as shown in FIG. 1. The apparatus main body 1 receives content data composed of image and sound data, and records the received content data onto a magnetic disk. The apparatus main body 1 further performs the reproduction of the content data recorded on the magnetic disk to output an image and a sound.

The remote controller 2 is to perform the remote control of the apparatus main body 1 by user's key operations to input various instructions.

Moreover, an external apparatus, such as a television receiver 200 and the like, is connected to the apparatus main body 1, and the content data reproduced in the apparatus main body 1 is output to the television receiver 200.

Figure 2:
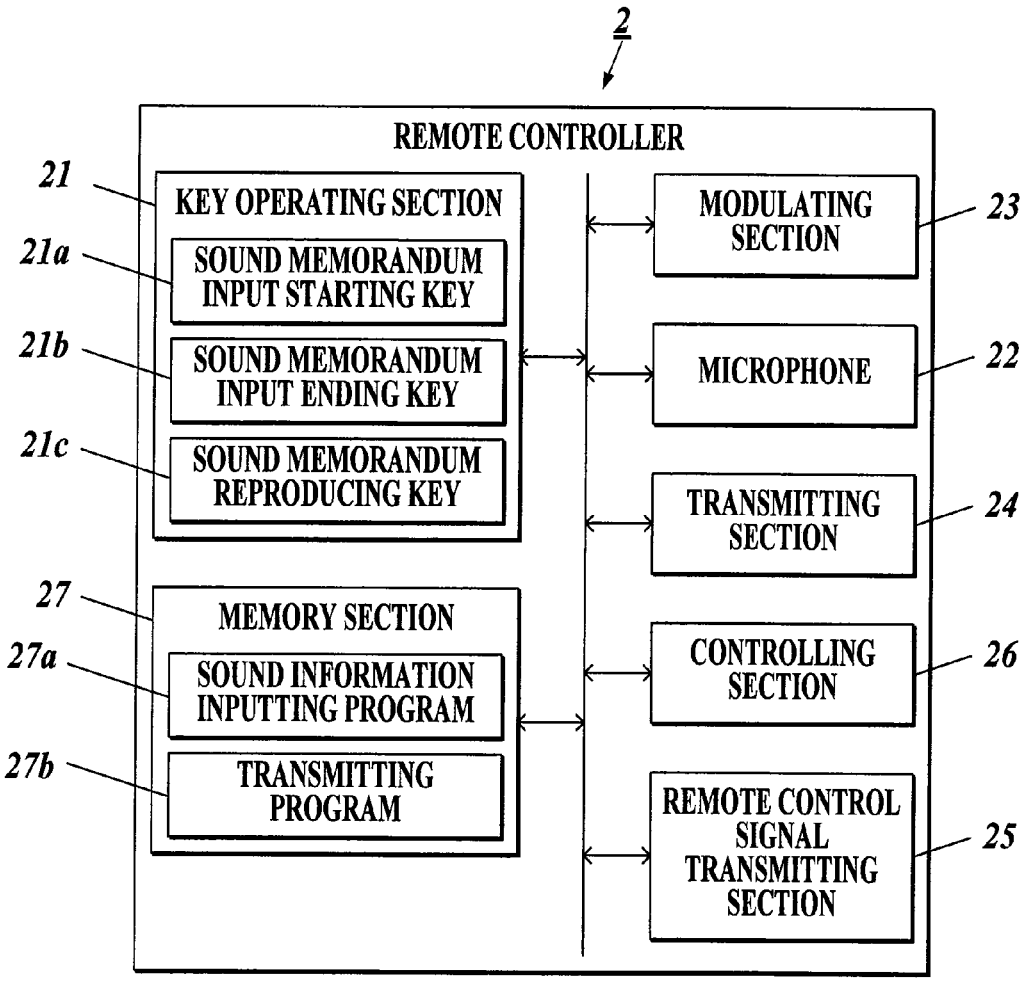
FIG. 2 is a block diagram showing the configuration of the principal part of a remote controller of the first embodiment.

The configuration of the principal part of the remote controller 2 is first described with reference to FIG. 2.

The remote controller 2 comprises a key operating section 21 provided with a plurality of keys, a microphone 22 as a sound information inputting section, a modulating section 23, a transmitting section 24 as a transmitting section, a remote control signal transmitting section 25, a controlling section 26, a memory section 27, and the like. The remote controller 2 performs the remote control of the apparatus main body 1 based on a key operation of the user.

The key operating section 21 comprises, for example, a sound memorandum input starting key 21*a*, a sound memorandum input ending key 21*b*, and a sound memorandum reproducing key 21*c*. When the user performs a depressing operation of one of these keys, a remote control signal of an infrared ray and the like, which remote control signal corresponding to the key subjected to the depressing operation is output to be input into a controlling section 14 of the apparatus main body 1 through a remote control signal receiving section 13 provided in the apparatus main body 1.

To put it concretely, the sound memorandum input starting key 21*a* is a key to start the input of sound information by the execution of a sound information inputting program 27*a* which will be described later, and the sound memorandum input ending key 21*b* is a key to end the input of sound information. Moreover, the sound memorandum reproducing key 21*c* is a key to reproduce the sound information recorded to be associated with a piece of content data.

The microphone 22 collects input sounds to convert the collected sounds into analog sound data.

The modulating section 23 modulates the sound data input from the microphone 22 by a modulation method, such as a frequency modulation (FM) method, and outputs the modulated sound data to the transmitting section 24.

The transmitting section 24 transmits the sound data input from the modulating section 23 to the apparatus main body 1.

The remote control signal transmitting section 25 transmits a remote control signal corresponding to a key depressed in the key operating section 21 to the apparatus main body 1 by an infrared ray and the like.

The controlling section 26 executes various programs stored in a ROM 143 in response to an input signal input from each section of the remote controller 2, an input operation signal input by a depression operation of one of the various keys in the key operating section 21, and the like. The controlling section 26 outputs an output signal to each section based on the executed programs to perform the integrated control of the whole operation of the remote controller 2

The memory section 27 comprises, for example, a program storing area made of a nonvolatile memory, and comprises the sound information inputting program 27*a*, a transmitting program 27*b*, and the like.

The sound information inputting program 27*a* is a program to enable the controlling section 26 to realize, for example, the function of allowing the user to input sound information.

To put it concretely, the user operates the key operating section 21 when the user inputs the sound information pertaining to content data, or when the user selects the content to be reproduced among the recorded content, and thereby makes a displaying section 200a of the television receiver 200 connected to the apparatus main body 1 display a content list displaying screen.

Figure 3:
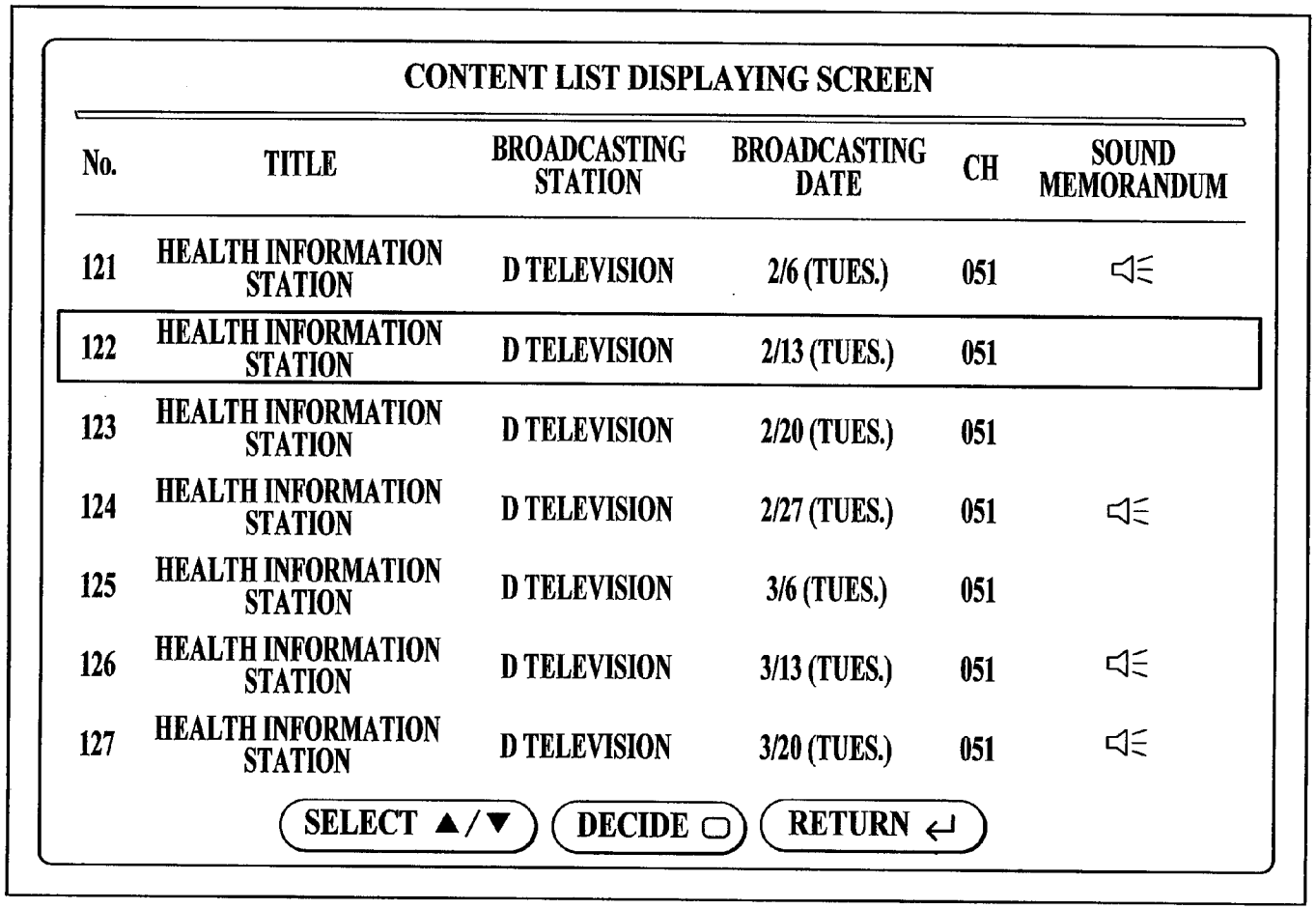
FIG. 3 is a view illustrating a content list displaying screen displayed in a displaying section.

FIG. 3 is a view illustrating the content list displaying screen to be displayed in the displaying section 200a. As shown in FIG. 3, the content list displaying screen displays the information pertaining to the content data of each recorded content, such as an identification number (for example, "No. 122") given on the equipment side, a title (for example, "health information station"), a broadcasting station (for example, "D television"), a broadcasting date (for example, "2/13 (Tues.)"), a channel (for example, "51ch"), and the like. Moreover, an icon indicating the attachment of a sound memorandum is displayed or is not displayed, in a state of being associated with the information pertaining to content data, and thereby the existence or the non-existence of the sound information corresponding to each piece of content is displayed.

When the user inputs the sound information pertaining to content data, the user makes the displaying section 200a display the content list displaying screen described above, and specifies the content data to which sound information as the sound memorandum is attached. The user then depresses the sound memorandum input starting key 21*a*, and speaks to the microphone 22 provided in the remote controller 2 to input the sound information, such as the information pertaining to the content of content data, which sound information being recorded to be associated with the content data (for example, "liver function improvement," "diet," and the like). When the input of the sound information has been completed, the user depresses the sound memorandum input ending key 21*b*.

When the sound information pertaining to one piece of content data has been input by the user through the microphone 22 and the sound memorandum input ending key 21*b* is depressed, the controlling section 26 converts the sound information input from the microphone 22 during the time of from the depression of the sound memorandum input starting key 21*a* until the depression of the sound memorandum input ending key 21*b* into predetermined analog sound data in the microphone 22, and outputs the converted predetermined analog sound data to the modulating section 23 to modulate the predetermined analog sound data by a predetermined modulation method.

The controlling section 26 functions as the sound information inputting section together with the microphone 22 by executing the sound information inputting program 27*a*.

The transmitting program 27*b* is a program to enable the controlling section 26 to realize, for example, the function of transmitting the sound data based on the sound information input by the execution of the sound information inputting program 27*a* to the apparatus main body 1.

To put it concretely, when the sound information input by the user through the microphone 22 has been modulated to the sound data of the predetermined modulation method by the modulating section 23 and the like, the controlling section 26 transmits the modulated sound data to the apparatus main body 1 by a wireless method with the transmitting section 24.

The controlling section 26 functions as the transmitting section together with the transmitting section 24 by executing the transmitting program 27*b*.

Figure 4A:
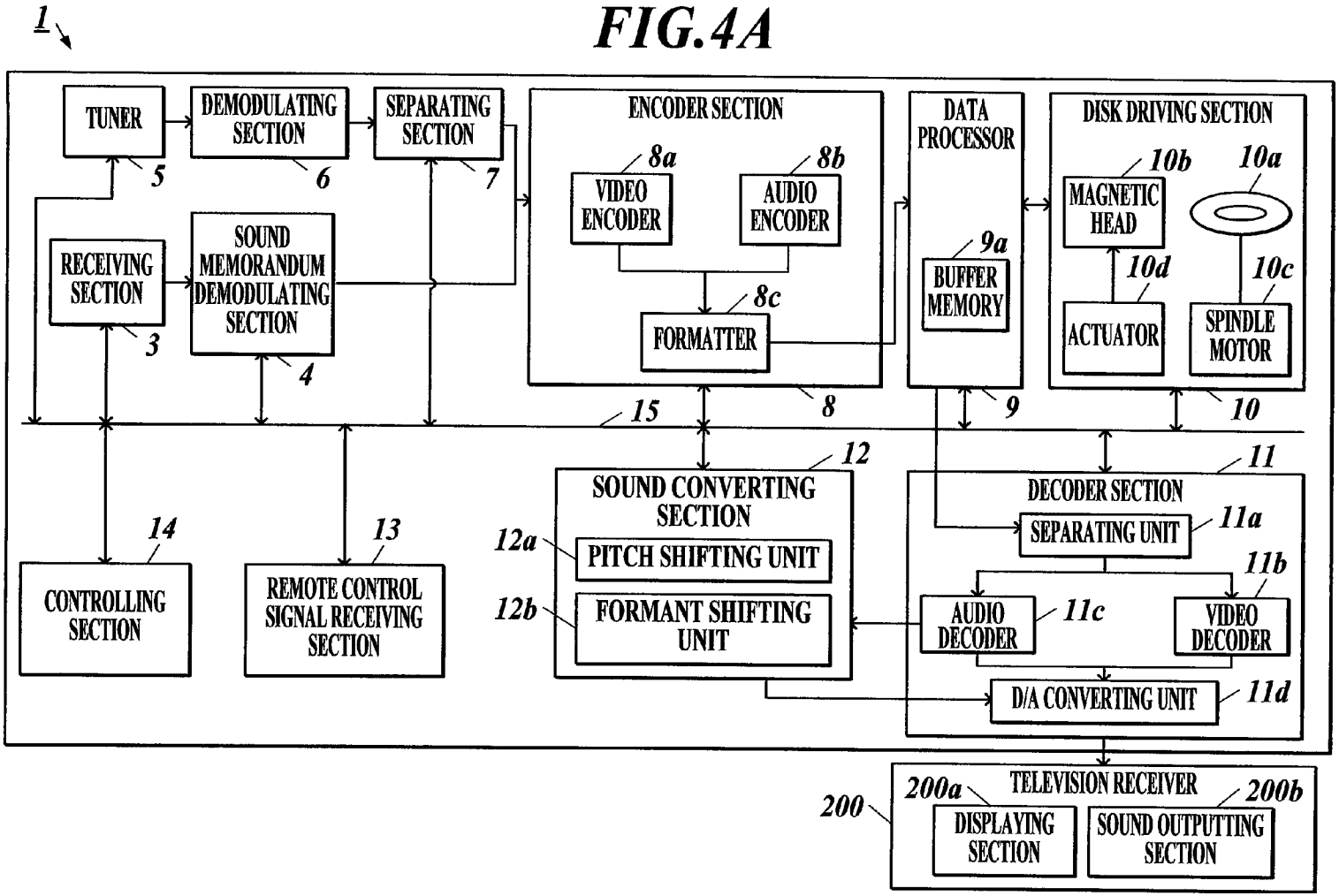
FIGS. 4A and 4B are block diagrams showing the configuration of the principal part of the apparatus main body of the first embodiment.
Figure 4B:
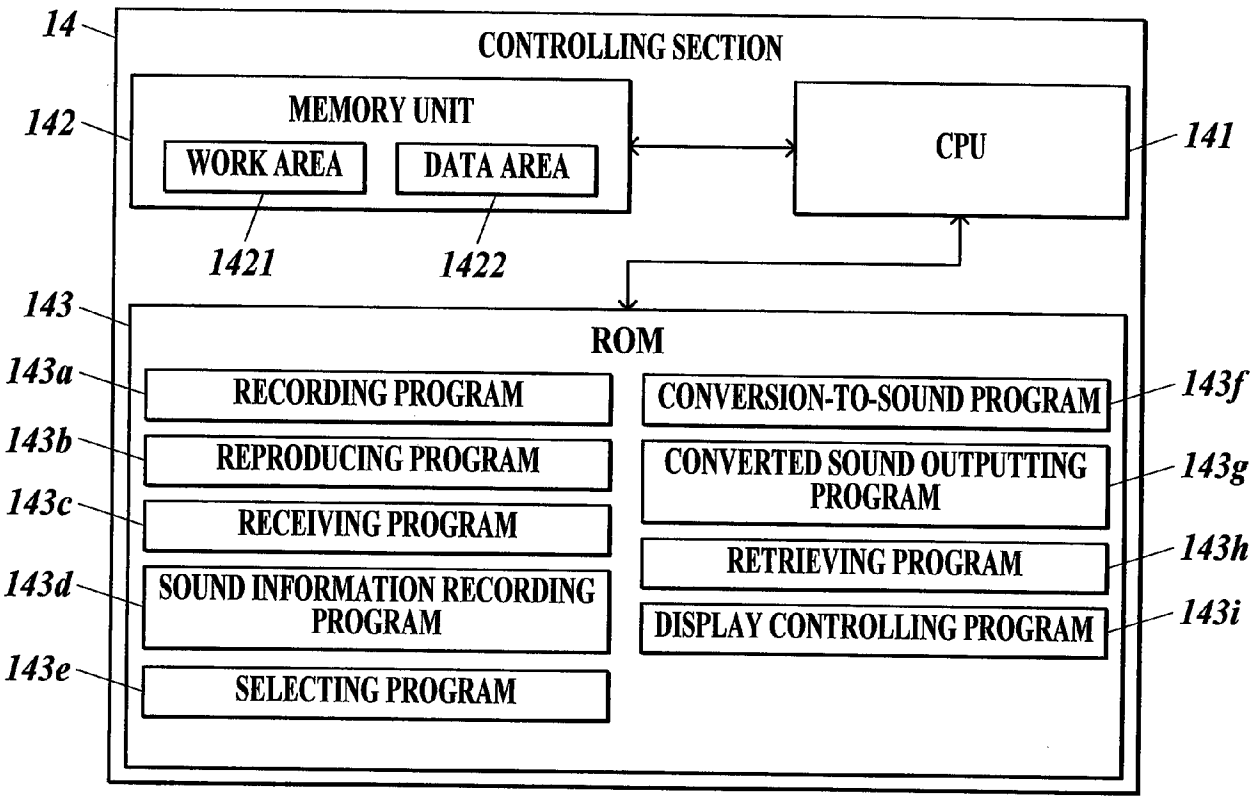

Next, the configuration of the principal part of the apparatus main body 1 is described with reference to FIGS. 4A and 4B.

The apparatus main body 1 comprises a receiving section 3 to receive the sound data transmitted from the remote controller 2 as a receiving section, a sound memorandum demodulating section 4 to demodulate the sound data received by the receiving section 3 by a predetermined demodulating system, a tuner 5 to tune the content data of a predetermined broadcasting channel among the broadcast signals received with an antenna and the like, a demodulating section 6 to demodulate a broadcast signal input from the tuner 5, a separating section 7 to separate a transport stream input from the demodulating section 6, an encoder section 8 to perform predetermined compressing processing of a stream input from the separating section 7, a data processor 9 to supply the content data input from the encoder section 8 to a disk driving section 10 and to supply the content data taken therein from the disk driving section 10 to a decoder section 11 by controlling the input and the output of the content data, the disk driving section 10 as a recording section, a reproducing section, and a sound information recording section that perform the recording and the reproducing of content data for a magnetic disk 10*a* as a recording medium, the decoder section 11 to perform the predetermined expanding processing of the content data output from the disk driving section 10, a sound converting section 12 to convert a natural sound into an artificial sound based on the sound data input from the decoder section 11, the remote control signal receiving section 13 to receive a remote control signal transmitted from the remote controller 2 and to output the remote control signal to the controlling section 14, the controlling section 14 to perform the integrated control of the whole apparatus main body 1, and the like. Each of the sections is connected with one another through a control bus 15.

The receiving section 3 receives the sound data transmitted from the transmitting section 24 of the remote controller 2.

The sound memorandum demodulating section 4 demodulates the sound data input from the receiving section 3 by the demodulating system such as the FM demodulation and the like, and outputs the demodulated sound data to an audio encoder 8*b* of the encoder section 8.

The tuner 5 comprises, for example, a high frequency amplifier circuit, and a frequency converter circuit composed of a local oscillator circuit and a mixing circuit, although their illustration is omitted. The tuner 5 mixes a digital television broadcast signal (radio frequency (RF) signal) input through the antenna and the like with a local oscillating signal output from the local oscillator circuit with the mixing circuit, and receives the television broadcast signal of a specific frequency band according to a control output to tune the frequency of the broadcast signal from the controlling section 14.

The demodulating section 6 executes, for example, the processing such as the digital demodulation and the error correction for a television broadcast signal output from the tuner 5 and generates a transport stream (TS) to output the generated TS to the separating section 7 based on the control of the controlling section 14.

The separating section 7 separates a video stream, an audio stream, and program specific information (PSI)/service information (SI) (program arrangement information) from a TS input from the demodulating section 6. The SI includes the information pertaining to content such as the title, the channel, the broadcasting station, the genre, the broadcast starting time, the broadcast ending time, the performer, the content of the program and the like, of the content included in the TS, and the SI is used as electronic program guide (EPG) information.

When a TS is input from the demodulating section 6 into the separating section 7, the separating section 7 separates a necessary TS packet from the input TS based on the PSI included in the TS. The separating section 7 then outputs the video stream under the Moving Picture Experts Group 2 (MPEG 2) standard and the audio stream in the separated TS packet to a video decoder 11*b* and an audio decoder 11*c*, respectively, and further outputs the EPG information obtained from the SI to a not-shown EPG decoder, the controlling section 14, and the like.

The encoder section 8 comprises, for example, a video encoder 8*a*, the audio encoder 8*b*, a formatter 8*c*, and the like.

The video encoder 8*a* compresses the video stream input from the separating section 7 in accordance with, for example, the MPEG 2 system. To put it concretely, the video encoder 8*a* performs the compression of an information quantity by performing various kinds of processing for an image signal, such as a discrete cosine transform (DCT), re-quantization, motion compensation, variable length coding, multiplexing and the like.

The audio encoder 8*b* compresses the sound data input from the sound memorandum demodulating section 4 and an audio stream input from the separating section 7 in accordance with, for example, the Dolby Audio Compression 3 (Dolby AC3) system. The audio encoder 8*b* which adopts the system once converts sound data into frequency components for every sampling period by the modified discrete cosine transform (MDCT), and performs the processing of the re-quantization, the assignment of the numbers of bits, and the like, of the converted frequency components to compress the information quantity of the sound data. The sound signal encoded by the audio encoder 8*b* is output to the formatter 8*c*.

The formatter 8*c* performs the stream synthesis of the image data input from the video encoder 8*a* and the sound data input from the audio encoder 8*b*, and converts the synthesized data into that having a file format by which the converted data can be written onto the magnetic disk 10*a* by the disk driving section 10. The formatter 8*c* then supplies the converted data to the data processor 9.

The data processor 9 comprises, for example, a buffer memory 9*a*, and sets input and output paths of sound and image data for the disk driving section 10, and controls the input and the output of data, such as the reading and the writing of data, based on the control outputs from a CPU 141.

To put it concretely, the data processor 9 performs the processing such as the error correction of, for example, the content data input from the encoder section 8, and once stores the processed content data into the buffer memory 9*a*. After that, the data processor 9 outputs the processed content data to the disk driving section 10 at a predetermined rate in response to a control output from the CPU 141, and performs the processing of error correction and the like of the content data read from the disk driving section 10. The data processor 9 once stores the processed content data into the buffer memory 9*a*, and then outputs the content data to the decoder section 11 at a predetermined rate in response to a control output from the CPU 141.

The disk driving section 10 comprises, for example, a built-in magnetic disk (recording medium) 10*a*, a magnetic head 10*b* to perform the recording of data onto the magnetic disk 10*a* and the reading of data recorded on the magnetic disk 10*a*, a spindle motor 10*c* to perform the rotation driving of the magnetic disk 10*a*, an actuator 10*d* to move the magnetic head 10*b* in a radial direction of the magnetic disk 10*a*, and the like. A minute gap to generate a magnetic field therein by receiving the supply of an electric current thereto is formed between the magnetic head 10*b* and the magnetic disk 10*a*. The magnetic disk 10*a* is then rotated at a high speed, and the actuator 10*d* moves the magnetic head 10*b* onto the magnetic disk 10*a*. The reading or the writing of data is then performed.

Figure 5:
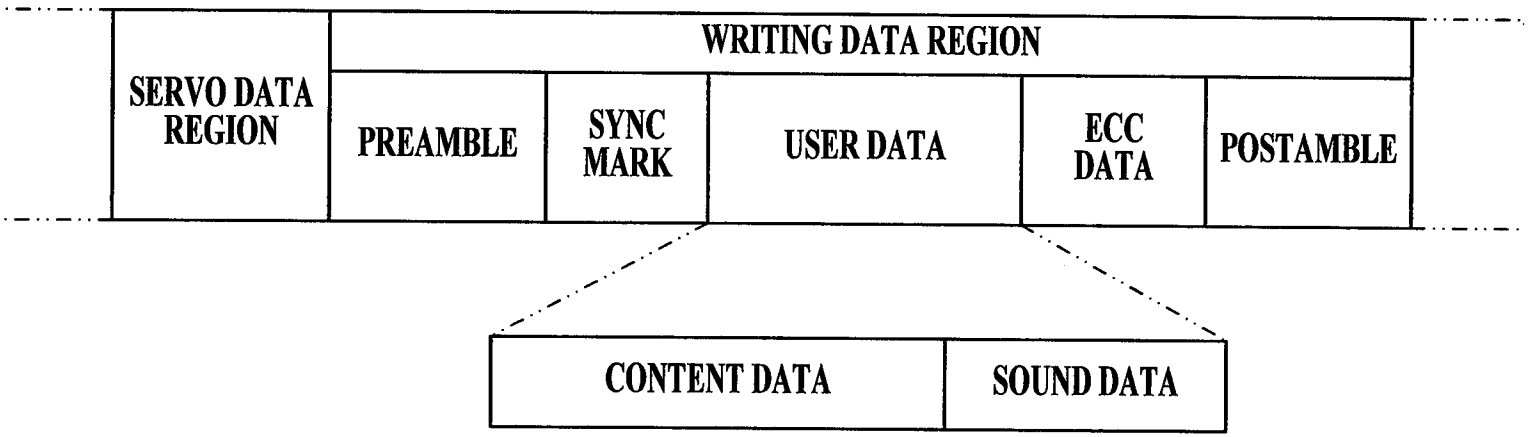
FIG. 5 is a view illustrating a data structure of data recorded on a magnetic disk.

The data to be recorded on the magnetic disk 10*a* is further described with reference to FIG. 5 here.

The magnetic disk 10*a* comprises a servo data region and a writing data region, which are radially embedded in radial directions of the magnetic disk 10*a*. The servo data region comprises a track number, a sector number, and burst data. When the disk driving section 10 receives a writing instruction and the address of a writing destination, the disk driving section 10 specifies the present position of the magnetic head 10*b* based on the servo data, and moves the magnetic head 10*b* to the aimed address to write data therein.

In the writing data region, a preamble, a sync mark, user data, an error correcting code (ECC), a postamble, and the like, are stored. In the user data region, content data is stored by the execution of a recording program 143*a*, and the sound data transmitted from the remote controller 2 is stored by the execution of a sound information recording program 143*d* which will be described below. Each piece of sound data is that based on the sound information input by a user, and is associated with a piece of content data recorded in a content region. Moreover, although illustration is omitted, EPG information extracted from the TS is stored in the user data region.

The decoder section 11 comprises, for example, a separating unit 11*a*, the video decoder 11*b*, the audio decoder 11*c*, a D/A converting unit 11*d* and the like.

The separating unit 11*a* separates the content data and sound information that have been output from the disk driving section 10 through the data processor 9 into a plurality of streams such as image data, sound data, and the like.

The video decoder 11*b* expands the image data input from the separating unit 11*a* in accordance with the MPEG 2 system. To put it concretely, the video decoder 11*b* performs the expansion of image data by performing various kinds of processing such as the variable length decoding, the inverse quantization, the inverse DCT, and the motion compensation of the image data.

The audio decoder 11*c* expands the sound data input from the separating unit 11*a* in accordance with the Dolby AC-3 system.

The D/A converting unit 11*d* converts quantized image data or quantized sound data into an analog quantity according to the quantized data, and thereby performs the analog conversion of the quantized image data or the quantized sound data.

The image data converted into the analog quantity by the D/A converting unit 11*d* is subjected to the synthesis with OSD data and the like in a not-shown OSD circuit, and the synthesized data is once stored in a not-shown frame memory. After that, the synthesized data is led to be output to the displaying section 200*a* of the television receiver 200 connected to the apparatus main body 1 according to a control output from the CPU 141. Moreover, the sound data converted to the analog quantity by the D/A converting unit 11*d* is led to be output to a sound outputting section 200*b* of the television receiver 200 connected to the apparatus main body 1.

The sound converting section 12 comprises, for example, a pitch shifting unit 12*a*, a formant shifting unit 12*b* and the like. When the sound data recorded on the magnetic disk 10*a* is read and is input into the sound converting section 12 through the data processor 9, the decoder section 11 and the like, the sound converting section 12 converts the input sound data into predetermined sound data in accordance with the control by the controlling section 14 in the execution of a conversion-to-sound program 143*f* which will be described below.

To put it concretely, the pitch shifting unit 12*a* converts the sound pitch of an input sound by changing the pitch frequency of the input sound data. Moreover, the formant shifting unit 12*b* converts the voice quality of the input sound by changing the formant frequency of the input sound data.

The remote control signal receiving section 13 receives a remote control signal of an infrared ray and the like output based on a user's depressing operation of one of the various keys provided in the key operating section 21 of the remote controller 2, and performs the processing such as the amplification, the detection, the error correction, and the like, of the received remote control signal to output the processed remote control signal to the controlling section 14.

The controlling section 14 comprises a central processing unit (CPU) 141, a memory unit 142, a read only memory (ROM) 143, and the like.

The CPU 141 executes various programs stored in the ROM 143 in response to an input signal input from each section of the apparatus main body 1, a remote control signal input through the remote control signal receiving section 13 by a depressing operation of one of the various keys in the key operating section 21 in the remote controller 2, and the like. The CPU 141 performs the integrated control of the whole operation of the HDD recorder 100 by outputting an output signal to each section of the apparatus main body 1 based on an executed program.

The memory unit 142 comprises, for example, a work area 1421 made of a volatile memory, such as a random access memory (RAM) and the like. The memory unit 142 stores processing results produced at the time of the execution of the various programs by the CPU 141, input data, and the like, into the work area 1421. Moreover, the memory unit 142 comprises a data area 1422 made of a nonvolatile memory, such as an erasable programmable ROM (EPROM) and the like.

The ROM 143 comprises, for example, a program storing area made of a nonvolatile memory. To put it concretely, in the program storing area, the ROM 143 stores a recording program 143*a*, a reproducing program 143*b*, a receiving program 143*c*, the sound information recording program 143*d*, a selecting program 143*e*, the conversion-to-sound program 143*f*, a converted sound outputting program 143*g*, a retrieving program 143*h*, a display controlling program 143*i*, and the like.

The recording program 143*a* is a program to enable the CPU 141 to realize, for example, the function of recording input content data onto the magnetic disk 10*a*.

To put it concretely, when, in the remote controller 2, a key operation is performed so that the recording of content data is instructed, and when tuning processing by the tuner 5 is performed, the reception of the content data is started. Then, the CPU 141 makes the demodulating section 6, the separating section 7, the encoder section 8, the data processor 9, and the like, perform the aforesaid processing to make the disk driving section 10 record the content data onto the magnetic disk 10*a*, which content data having been converted to have a format in which the recording of the content data can be performed onto the magnetic disk 10*a*.

The CPU 141 functions as the recording section together with the disk driving section 10 by executing this recording program 143*a*.

The reproducing program 143*b* is a program to enable the CPU 141 to realize, for example, the function of reproducing the content data recorded on the magnetic disk 10*a* by the execution of the recording program 143*a*.

To put it concretely, when a key operation is performed in the remote controller 2 so that the reproduction of the content data recorded on the magnetic disk 10*a* is instructed, the CPU 141 reads the content data recorded on the magnetic disk 10*a* in the disk driving section 10, and makes the data processor 9, the decoder section 11, and the like, perform the aforesaid processing to output the processed content data to the television receiver 200 connected to the apparatus main body 1. The CPU 141 thereby allows the television receiver 200 to display an image in the displaying section 200*a*, and allows the television receiver 200 to output a sound with the sound outputting section 200*b*.

The CPU 141 functions as the reproducing section together with the disk driving section 10 by executing the reproducing program 143*b*.

The receiving program 143*c* is a program to enable the CPU 141 to realize, for example, the function of receiving the sound data transmitted from the remote controller 2 by the execution of the transmitting program 27*b* in the remote controller 2.

To put it concretely, when the sound data based on the sound information that a user has input is transmitted from the transmitting section 24 of the remote controller 2, the CPU 141 receives the sound data with the receiving section 3.

The CPU 141 functions as the receiving section together with the receiving section 3 by executing the receiving program 143*c*.

The sound information recording program 143*d* is a program to enable the CPU 141 to realize, for example, the function of recording the sound data received by the execution of the receiving program 143*c* in a state where the sound data is associated with a piece of content data.

To put it concretely, when the sound data transmitted from the remote controller 2 is received in the receiving section 3 by the execution of the receiving program 143*c*, the CPU 141 makes the sound memorandum demodulating section 4 demodulate the received sound data, and makes the audio encoder 8*b* perform the compressing processing and the like of the sound data to convert the sound data to have a format in which the sound data can be recorded onto the magnetic disk 10*a*. After that, the CPU 141 outputs the converted sound data to the disk driving section 10 to make the disk driving section 10 record the sound data to be associated with a piece of content data recorded in the user data region.

The CPU 141 functions as the sound information recording section together with the disk driving section 10 by executing the sound information recording program 143*d*.

The selecting program 143*e* is a program to enable the CPU 141 to realize, for example, the function of selecting the conversion-to-sound mode of the predetermined sound data that is to be converted by the execution of the conversion-to-sound program 143*f* among a plurality of conversion-to-sound modes based on a key operation in the key operating section 21 in the remote controller 2.

Figure 6:
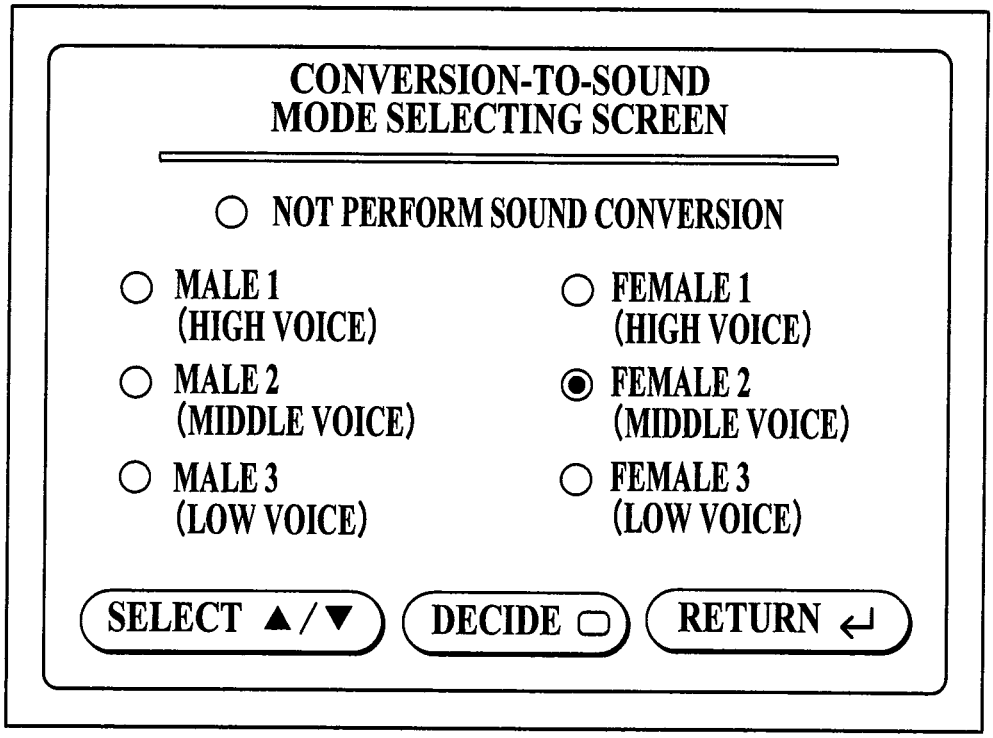
FIG. 6 is a view illustrating a conversion-to-sound mode selecting screen displayed in a displaying section of a television receiver in the execution of a selecting program.

FIG. 6 illustrates a conversion-to-sound mode selecting screen to be displayed in the displaying section 200*a* of the television receiver 200 in the execution of the selecting program 143*e*. As shown in FIG. 6, the conversion-to-sound mode selecting screen is adapted to allow the user to select the conversion-to-sound mode at the time of reproducing the sound data recorded on the magnetic disk 10*a* based on the sound information that the user has input among a plurality of conversion-to-sound modes in which the pitch of sounds and voice qualities, such as "male 1 (high voice), male 2 (middle voice), male 3 (low voice), female 1 (high voice), female 2, (middle voice), and female 3 (low voice)," different from one another. Moreover, the conversion-to-sound mode selecting screen is adapted to allow the user to select the item of "not performing sound conversion," to allow the user to output the user's voice without performing the sound converting processing of the sound data.

When the user specifies a conversion-to-sound mode by operating up-down keys, a decision key, and the like, of the remote controller 2 among the conversion-to-sound modes, the CPU 141 selects the conversion-to-sound mode specified by the user (for example, "female 2"), and stores the conversion-to-sound mode in a predetermined region in the memory unit 142.

The CPU 141 functions as a selecting section by executing this selecting program 143*e*.

The conversion-to-sound program 143*f* is a program to enable the CPU 141 to realize, for example, the function of converting the sound data recorded by the execution of the sound information recording program 143*d* into the predetermined sound data.

To put it concretely, the user makes the displaying section 200*a* display the content list displaying screen illustrated in FIG. 3 when the user selects the content to be reproduced among the pieces of recorded content, and the like. In the content list displaying screen, as described above, the information pertaining to the content, such as the identification number, the title, the broadcasting station, the broadcasting date, the channel and the like of each piece of content is displayed, and the icon indicating the attachment of a sound memorandum is displayed or is not displayed. Thereby, the existence or non-existence of sound information is displayed. The user specifies the content data in which the icon indicating the attachment of the sound memorandum pertaining to the content is displayed, and depresses the sound memorandum reproducing key 21*c*.

When a piece of content data having sound information is specified and when the sound memorandum reproducing key 21*c* is depressed, the CPU 141 reads the sound data recorded to be associated with the content data from the magnetic disk 10*a* and outputs the read sound data to the sound converting section 12 through the data processor 9, the decoder section 11, and the like, with the disk driving section 10. The CPU 141 then makes the pitch shifting unit 12*a* and the formant shifting unit 12*b* of the sound converting section 12 convert the output sound data into the sound of the conversion-to-sound mode (for example, "female 2") that has been selected by the user in the execution of the selecting program 143*e* and has been stored in the predetermined region of the memory unit 142, and the like.

The CPU 141 functions as a conversion-to-sound section by executing the conversion-to-sound program 143*f*.

The converted sound outputting program 143*g* is a program to enable the CPU 141 to realize, for example, the function of outputting the sound based on the predetermined sound data converted by the execution of the conversion-to-sound program 143*f*.

To put it concretely, the CPU 141 makes the D/A converting unit 11*d* perform the analog conversion of the sound data converted into the sound of the conversion-to-sound mode selected by the user in the execution of the conversion-to-sound program 143*f*, and makes a not-shown amplifying section perform the amplifying processing of the converted sound data to output the sound based on the sound data from the sound outputting section 200*b* of the television receiver 200.

Thereby, the sound memorandum attached to the content data (for example, "liver function improvement") is led to be reproduced as the sound of the selected conversion-to-sound mode. Consequently, the user can easily grasp the content and the like of the content data by inputting the sound memorandum indicating the content and the like of the content data by the user's own voice to reproduce the sound memorandum.

The CPU 141 functions as a converted sound outputting section (sound information outputting section) by executing the converted sound outputting program 143*g*.

The retrieving program 143*h* is a program to enable the CPU 141 to realize, for example, the function of retrieving the sound data including a predetermined key word (predetermined word and phrase) among the pieces of sound data recorded by the execution of the sound information recording program 143*d* based on the key operation in the key operating section 21 of the remote controller 2.

To put it concretely, when the user retrieves the content data including a specific key word in sound information (sound data) among the pieces of recorded content data, the user makes the displaying section 200*a* of the television receiver 200 display a content retrieving screen.

Figure 7:
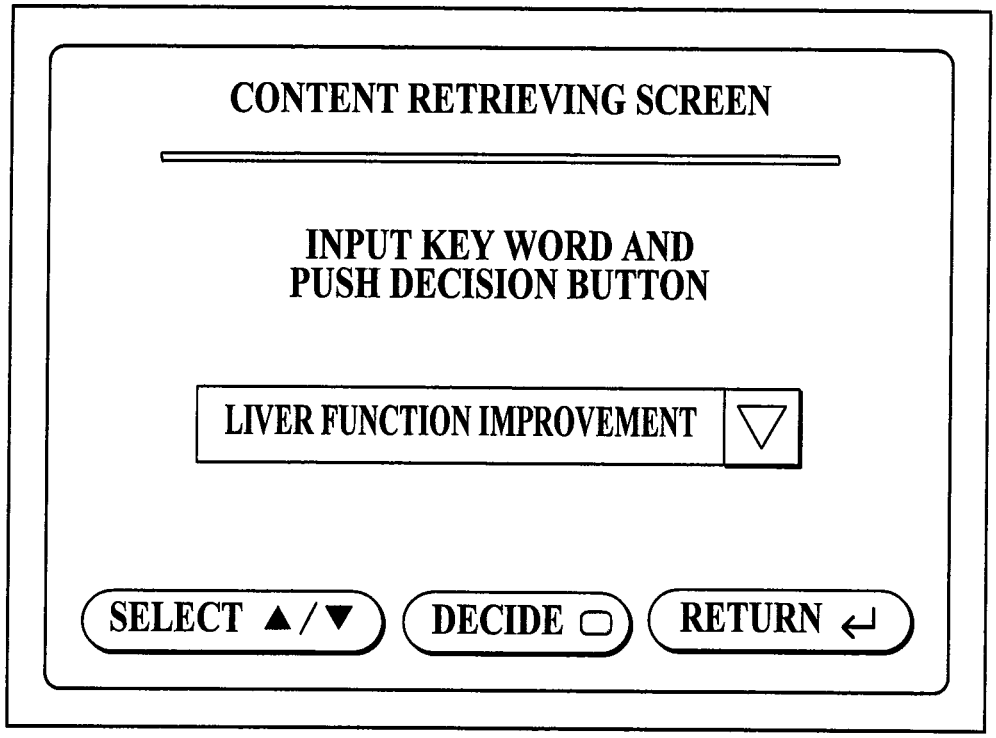
FIG. 7 is a view illustrating a content retrieving screen displayed in the displaying section in the execution of a retrieving program.

FIG. 7 illustrates the content retrieving screen to be displayed in the displaying section 200*a* of the television receiver 200 in the execution of the retrieving program 143*h*. The user operates the key operating section 21 of the remote controller 2 in the content retrieving screen illustrated in FIG. 7 to input the key word. When the user inputs the key word in the content retrieving screen, the CPU 141 performs the sound recognizing processing of the sound data stored onto the magnetic disk 10*a* to be associated with each piece of content data to perform the search of the sound information including the key word based on the key word as a retrieval object.

The CPU 141 functions as a retrieving section by executing this retrieving program 143*h*.

The display controlling program 143*i* is a program to enable the CPU 141 to realize, for example, the function of making the displaying section 200*a* display the information pertaining to the content data associated with the sound data including the predetermined word and phrase, which sound data having been retrieved by the execution of the retrieving program 143*h*.

To put it concretely, when the sound data including the key word input in the content retrieving screen by the user is retrieved by the execution of the retrieving program 143*h*, the CPU 141 makes the displaying section 200*a* display the information pertaining to the content data based on the EPG information of the content data recorded to be associated with the sound data.

Figure 8:
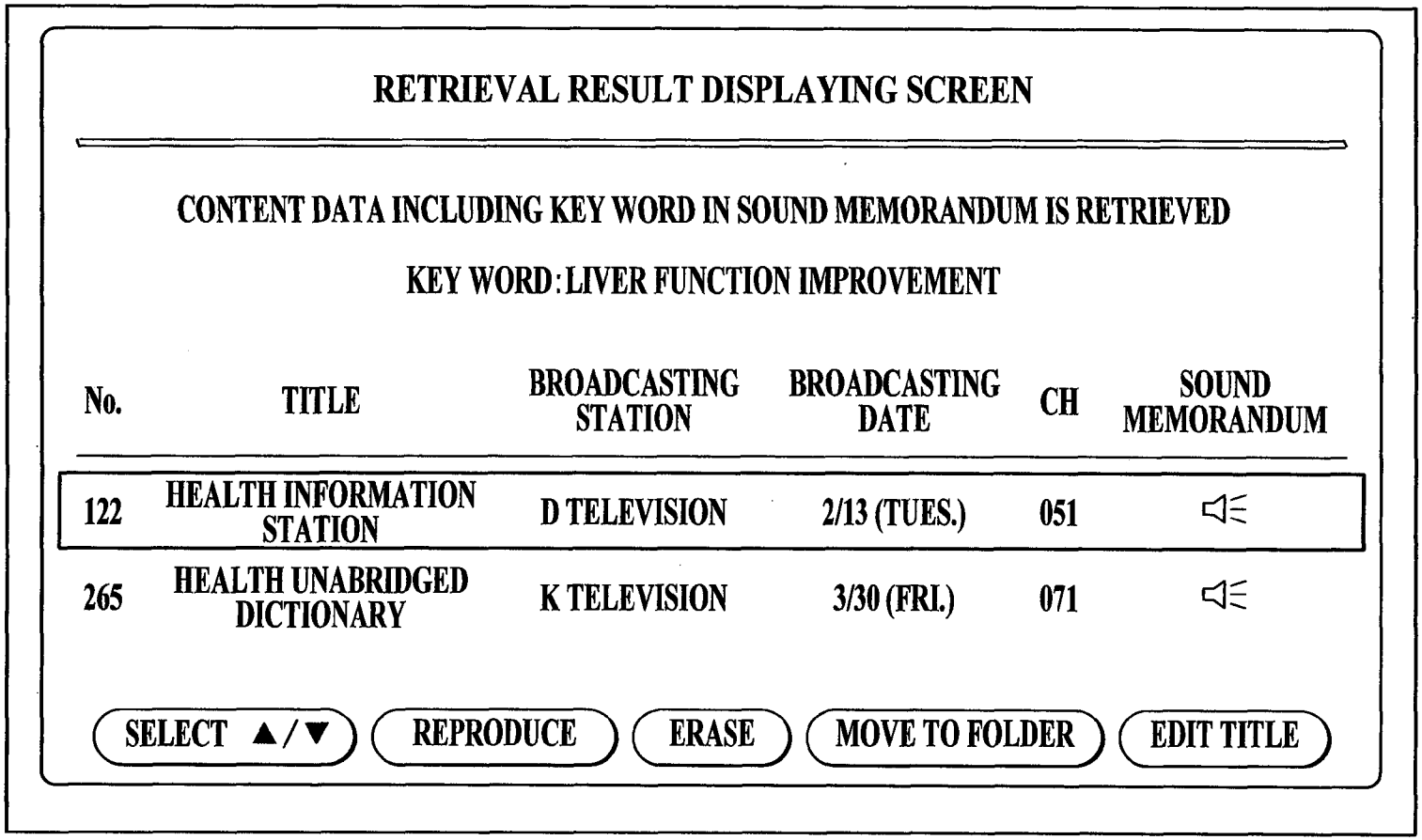
FIG. 8 is a view illustrating a retrieval result displaying screen displayed in the displaying section in the execution of a display controlling program.

FIG. 8 is a view illustrating a retrieval result displaying screen to be displayed in the displaying section 200*a* by the execution of the display controlling program 143*i*. As shown in FIG. 8, in the retrieval result displaying screen, the information pertaining to the retrieved content data, such as the identification number, the title, the broadcasting station, the broadcasting date, and the channel of the content data, is displayed as the retrieval results of the content data with which the sound data including the key word input by the user in the content retrieving screen (for example, "liver function improvement") is associated. The information pertaining to the content data is obtained from the EPG information that has been extracted from the TS at the time of the reception of the content data and has been recorded on the magnetic disk 10*a* in advance.

The user can thereby easily grasp the content data including the key word in the sound memorandum, and can easily access the content data to perform the reproduction, the elimination, the dubbing, the movement to a folder, the editing of the title, and the like, of the content data.

The CPU 141 functions as a display controlling section by executing the display controlling program 143*i*.

According to the HDD recorder 100 in the first embodiment described above, the remote controller 2 is provided with the key operating section 21 to receive a user's key operation. Sound information is input by the user by the execution of the sound information inputting program 27*a* by the controlling section 26, and the sound data based on the sound information input by the execution of the sound information inputting program 27*a* is transmitted to the apparatus main body 1 by the execution of the transmitting program 27*b*. Moreover, in the apparatus main body 1, input content data is recoded on the magnetic disk 10*a* by the execution of the recording program 143*a* by the CPU 141, and the content data recorded on the magnetic disk 10*a* by the execution of the recording program 143*a* is reproduced by the execution of the reproducing program 143*b*. Moreover, the sound data transmitted from the remote controller 2 by the execution of the transmitting program 27*b* is received by the execution of the receiving program 143*c* by the CPU 141, and the sound data received by the execution of the receiving program 143*c* is recorded to be associated with a piece of content data by the execution of the sound information recording program 143*d*. The sound data recorded by the execution of the sound information recording program 143*d* is converted into the predetermined sound data by the execution of the conversion-to-sound program 143*f*, and the sound based on the predetermined sound data converted by the execution of the conversion-to-sound program 143*f* is output by the execution of the converted sound outputting program 143*g*. The conversion-to-sound mode of the predetermined sound data converted by the execution of the conversion-to-sound program 143*f* is selected among the plurality of conversion-to-sound modes based on a key operation in the key operating section 21 by the execution of the selecting program 143*e*, and the sound data including the predetermined word and phrase is retrieved among the sound data recorded by the execution of the sound information recording program 143*d* based on the key operation in the key operating section 21 by the execution of the retrieving program 143*h*. The information pertaining to the content data associated with the sound data including the predetermine word and phrase, which sound data having been retrieved by the execution of the retrieving program 143*h*, is displayed in the displaying section 200*a* by the execution of the display controlling program 143*i*.

Consequently, in the HDD recorder 100, it becomes possible to input sound information with the microphone 22 provided in the remote controller 2, and to transmit the sound information to the apparatus main body 1 to make the apparatus main body 1 record the sound information. It becomes possible to input the sound information related to recorded content by a simpler method by the remote control using the remote controller 2. Moreover, because the input sound information is converted to a sound desired by a user to be reproduced, the usability of the HDD recorder 100 can be improved for the user. Furthermore, the user can easily grasp the information pertaining to the content data of the sound information including the predetermined word and phrase, and can easily access the content data of the sound information including the predetermined word and phrase.

(Second Embodiment)

Figure 9:
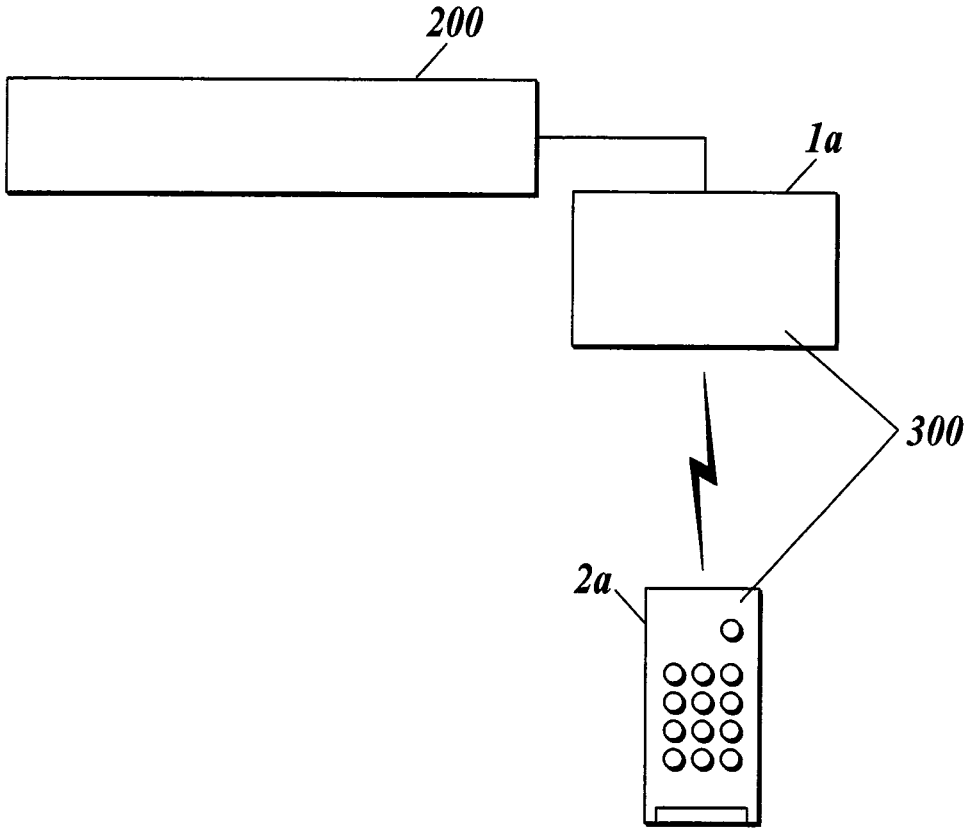
FIG. 9 is a view showing the whole configuration of an HDD recorder of a second embodiment.

In a second embodiment, descriptions are given to an exemplified HDD recorder 300 to perform recording to a magnetic disk as a recording and reproducing apparatus similarly to the first embodiment. The HDD recorder 300 of the present second embodiment comprises an apparatus main body 1*a* and a remote controller 2*a* as shown in FIG. 9. The apparatus main body 1*a* receives content data composed of image and sound data, and records the received content data onto a magnetic disk. The apparatus main body 1*a* further performs the reproduction of the content data recorded on the magnetic disk to output an image and a sound. The remote controller 2*a* is to perform the remote control of the apparatus main body 1*a* by user's key operations to input various instructions.

Incidentally, the same components as those of the HDD recorder 100 of the first embodiment are denoted by the same symbols as those of the HDD recorder 100, and the descriptions thereof are omitted.

Figure 10:
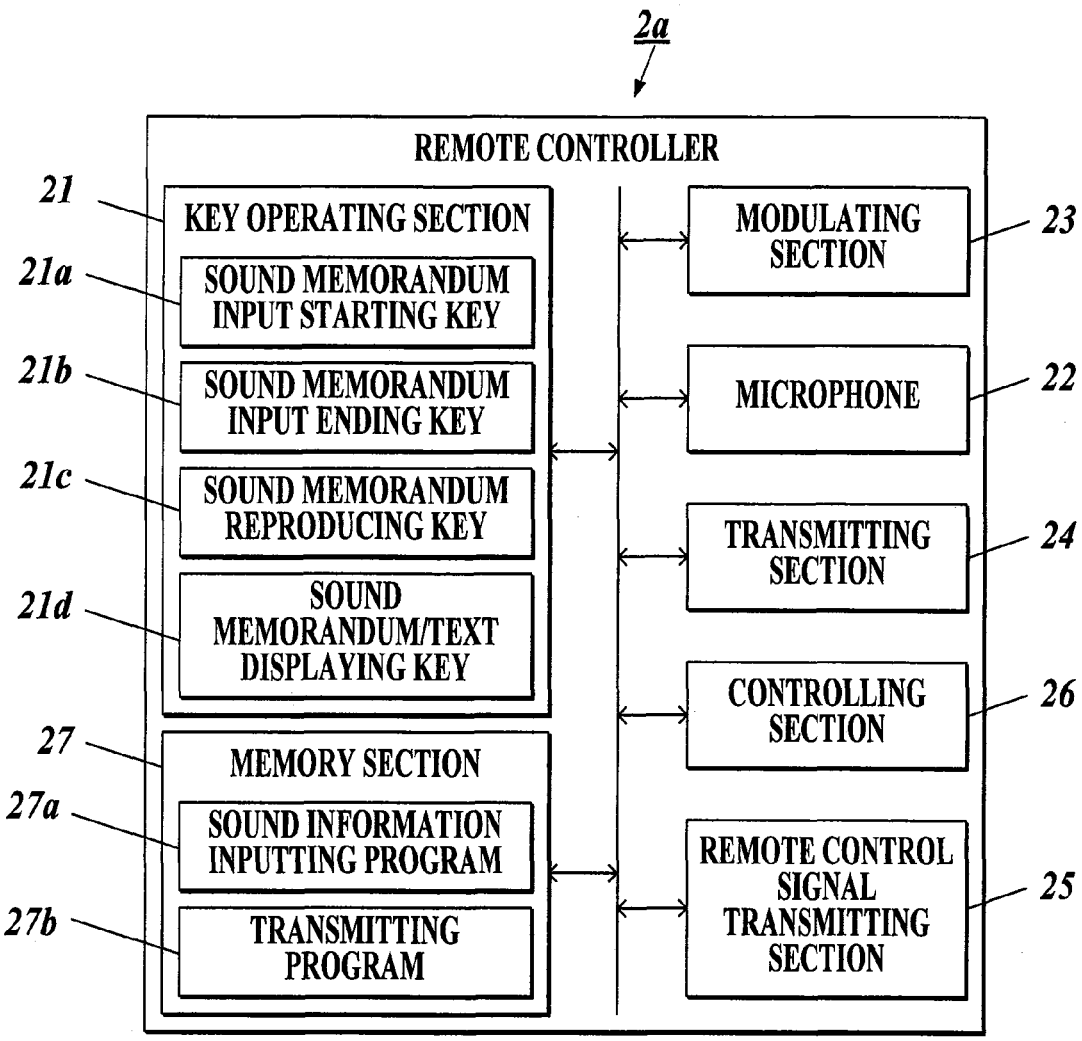
FIG. 10 is a block diagram showing the configuration of the principal part of a remote controller of the second embodiment.

The configuration of the principal part of the remote controller 2*a* is first described with reference to FIG. 10.

The remote controller 2*a* comprises the key operating section 21 provided with a plurality of keys, the microphone 22, the modulating section 23, the transmitting section 24, the remote control signal transmitting section 25, the controlling section 26, the memory section 27, and the like, and the remote controller 2*a* performs the remote control of the apparatus main body 1*a* based on a key operation of the user.

The key operating section 21 comprises, for example, the sound memorandum input starting key 21*a*, the sound memorandum input ending key 21*b*, the sound memorandum reproducing key 21*c*, a sound memorandum/text displaying key 21*d* and the like.

The sound memorandum/text displaying key 21*d* is a key to make the displaying section 200*a* display the sound information recorded to be associated with a piece of content data as character information.

Figure 11A:
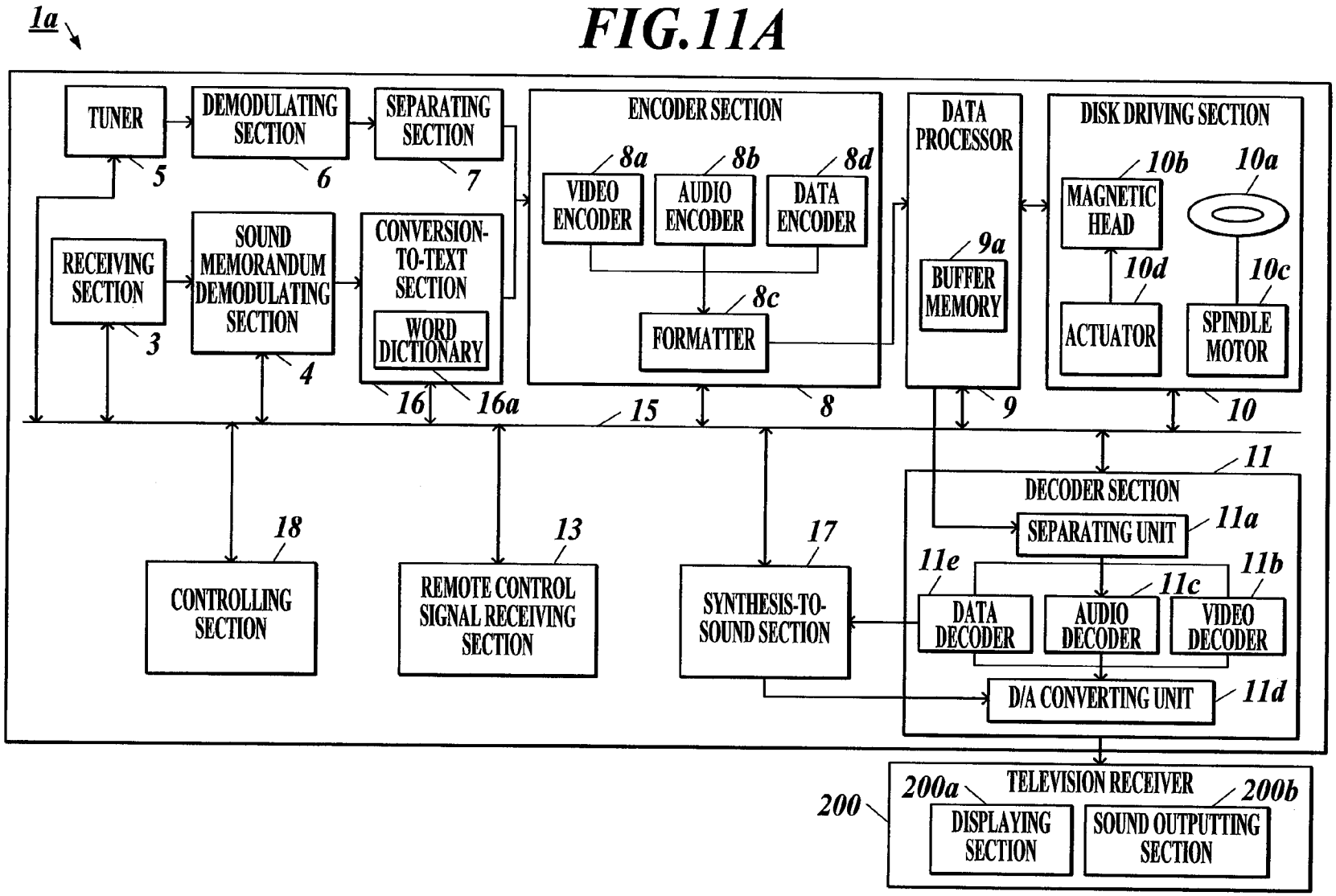
FIGS. 11A and 11B are block diagrams showing the configuration of the principal part of the apparatus main body of the second embodiment.
Figure 11B:
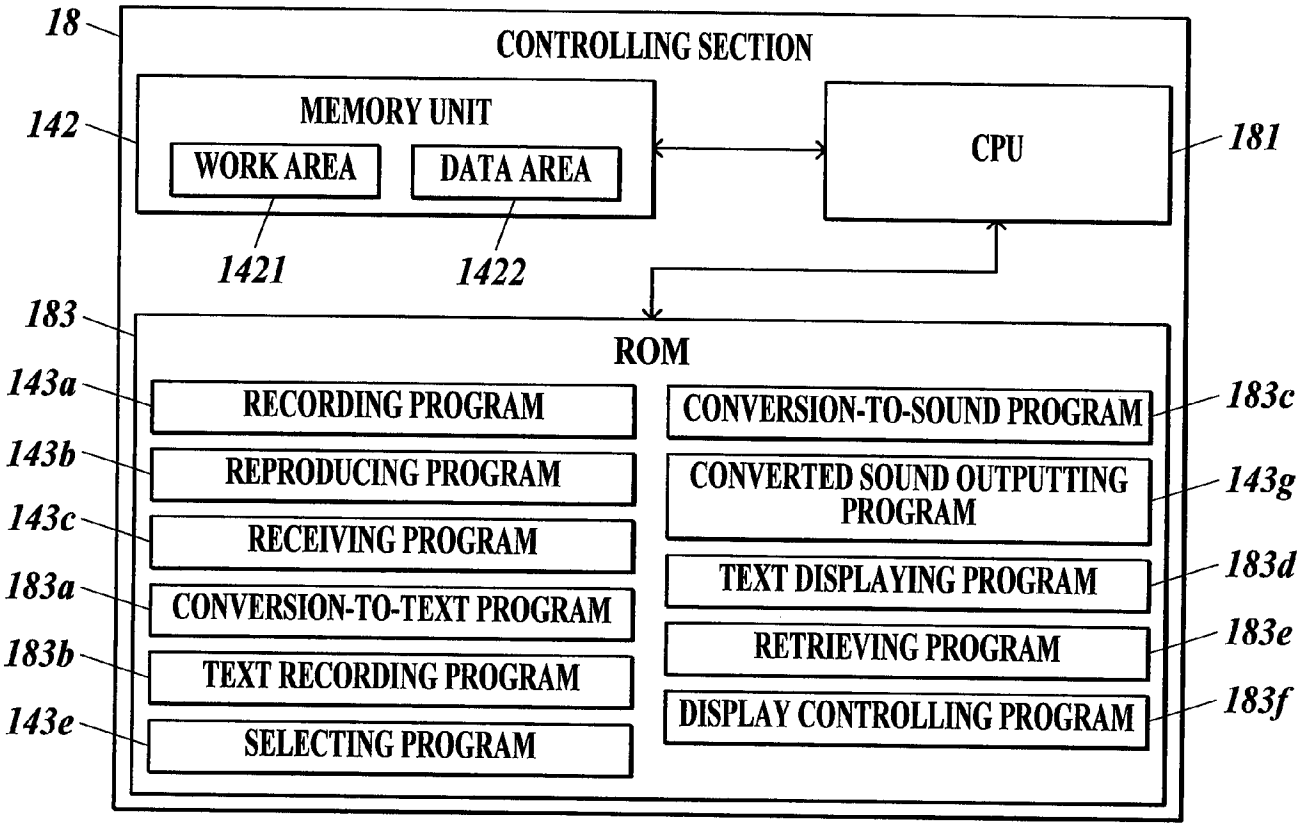

Next, the configuration of the principal part of the apparatus main body 1*a* is described with reference to FIGS. 11A and 11B.

The apparatus main body 1*a* comprises the receiving section 3 to receive the sound data transmitted from the remote controller 2*a* as the receiving section, the sound memorandum demodulating section 4 to demodulate the sound data received by the receiving section 3 by a predetermined demodulating system, a conversion-to-text section 16 to convert the sound data demodulated by the sound memorandum demodulating section 4 into text data by performing sound recognizing processing, the tuner 5 to tune the content data of a predetermined broadcasting channel among broadcast signals received with an antenna and the like, the demodulating section 6 to demodulate a broadcast signal input from the tuner 5, the separating section 7 to separate a transport stream input from the demodulating section 6, the encoder section 8 to perform predetermined compressing processing of a stream input from the separating section 7, the data processor 9 to supply the content data input from the encoder section 8 to the disk driving section 10 and to supply the content data taken therein from the disk driving section 10 to the decoder section 11 by controlling the input and the output of the content data, the disk driving section 10 as the recording section, the reproducing section, and a text recording section that perform the recording and the reproducing of content data for the magnetic disk 10*a* as the recording medium, the decoder section 11 to perform the predetermined expanding processing of the content data output from the disk driving section 10, a synthesis-to-sound section 17 as the conversion-to-sound section that performs sound synthesis based on the text data input from the decoder section 11 to output an artificial sound, the remote control signal receiving section 13 to receive a remote control signal transmitted from the remote controller 2*a* and to output the remote control signal to a controlling section 18, the controlling section 18 to perform the integrated control of the whole apparatus main body 1*a*, and the like. Each of the sections is connected with one another through the control bus 15.

The conversion-to-text section 16 is provided with, for example, a word dictionary 16*a* to convert the sound information input from the sound memorandum demodulating section 4 into text data by performing the sound recognizing processing of the sound information in accordance with the control of the controlling section 18.

The sound recognition is realized by accumulating statistical data of enormous sound patterns and language patterns with the sound recognizing software called as Julius. The basic principle of the sound recognition is to hold the frequency pattern of a sound model (a phoneme (almost corresponding to a Roman character) or a syllable (corresponding to a Japanese alphabet)) and to perform the matching of a syllable string signal composed of monosyllables cut out of the sound waveform signal of the input sound with the word dictionary 16*a* by referring to the word dictionary 16*a*. Thus, the sound recognition is performed.

The encoder section 8 comprises, for example, the video encoder 8*a*, the audio encoder 8*b*, a data encoder 8*d*, the formatter 8*c*, and the like.

The data encoder 8*d* performs predetermined compressing processing to the text data input from the conversion-to-text section 16.

The data to be recorded on the magnetic disk 10*a* built in the disk driving section 10 is described here.

The magnetic disk 10*a* comprises the servo data region and the writing data region, which are radially embedded in radial directions of the magnetic disk 10*a*. In the user data region of the writing data region, content data is stored by the execution of the recording program 143*a*, and the text data based on the sound information transmitted from the remote controller 2*a* is stored by the execution of a text recording program 183*b*, which will be described below. Each piece of text data is that based on the sound information input by a user, and is associated with a piece of content data recorded in the content region.

The decoder section 11 comprises, for example, the separating unit 11*a*, the video decoder 11*b*, the audio decoder 11*c*, a data decoder 11*e*, the D/A converting unit 11*d* and the like.

The data decoder lie performs predetermined expanding processing of the text data input from the disk driving section 10 through the data processor 9.

The synthesis-to-sound section 17 generates sound waveform data in accordance with a sound synthesis parameter generated based on the sound recognizing processing in the conversion-to-text section 16, and outputs the generated sound waveform data to the D/A converting unit 11*d*. The sound waveform data generated in the synthesis-to-sound section 17 is led to be subjected to the analog conversion in the D/A converting unit 11*d*, and is output from the sound outputting section 200*b* of the television receiver 200.

The controlling section 18 comprises a CPU 181, the memory unit 142, a ROM 183, and the like.

The CPU 181 executes various programs stored in the ROM 183 in response to an input signal input from each section of the apparatus main body 1*a*, a remote control signal input through the remote control signal receiving section 13 by a depressing operation of the various keys in the key operating section 21 in the remote controller 2*a*, and the like. The CPU 181 performs the integrated control of the whole operation of the HDD recorder 300 by outputting an output signal to each section of the apparatus main body 1*a* based on an executed program.

The ROM 183 comprises, for example, a program storing area made of a nonvolatile memory. To put it concretely, in the program storing area, the ROM 183 stores the recording program 143*a*, the reproducing program 143*b*, the receiving program 143*c*, a conversion-to-text program 183*a*, the text recording program 183*b*, the selecting program 143*e*, a conversion-to-sound program 183*c*, the converted sound outputting program 143*g*, a text displaying program 183*d*, a retrieving program 183*e*, a display controlling program 183*f*, and the like.

The conversion-to-text program 183*a* is a program to enable the CPU 181 to realize, for example, the function of converting the sound data received by the execution of the receiving program 143*c* into text data.

To put it concretely, when the receiving section 3 receives the sound data transmitted from the remote controller 2*a* by the execution of the receiving program 143*c*, the CPU 181 demodulates the received sound data in the sound memorandum demodulating section 4, and performs the sound recognizing processing of the sound data as an object of the sound recognizing processing in the conversion-to-text section 16 to output text data.

The CPU 181 functions as a conversion-to-text section together with the conversion-to-text section 16 by executing the conversion-to-text program 183*a*.

The text recording program 183*b* is a program to enable the CPU 181 to realize, for example, the function of recording the text data converted by the execution of the conversion-to-text program 183*a* to be associated with a piece of content data.

To put it concretely, when the sound data transmitted from the remote controller 2*a* has been converted into the text data in the conversion-to-text section 16, the CPU 181 performs the compressing processing and the like of the text data in the data encoder 8*d*, and converts the text data to have the format in which the text data can be recorded onto the magnetic disk 10*a*. After that, the CPU 181 outputs the converted text data to the disk driving section 10, and makes the disk driving section 10 record the text data to be associated with a piece of content data recorded in the user data region.

The CPU 181 functions as the text recording section together with the disk driving section 10 by executing the text recording program 183*b*.

The conversion-to-sound program 183*c* is a program to enable the CPU 181 to realize, for example, the function of converting the text data recorded by the execution of the text recording program 183*b* into predetermined sound data.

The CPU 181 functions as the conversion-to-sound section together with the synthesis-to-sound section 17 by executing the conversion-to-sound program 183*c*.

The text displaying program 183*d* is a program to enable the CPU 181 to realize, for example, the function of making the displaying section 200*a* display the character information based on the text data recorded by the execution of the text recording program 183*b*, based on a key operation in the key operating section 21 of the remote controller 2*a*.

To put it concretely, when a piece of content data has been specified by the user in the key operating section 21 of the remote controller 2*a* and the sound memorandum/text displaying key 21*d* is depressed, the CPU 181 reads the text data recorded on the magnetic disk 10*a* to be associated with the content data by the disk driving section 10, and makes the displaying section 200*a* display the read text data as character information through the data processor 9, the decoder section 11, and the like.

Figure 12:
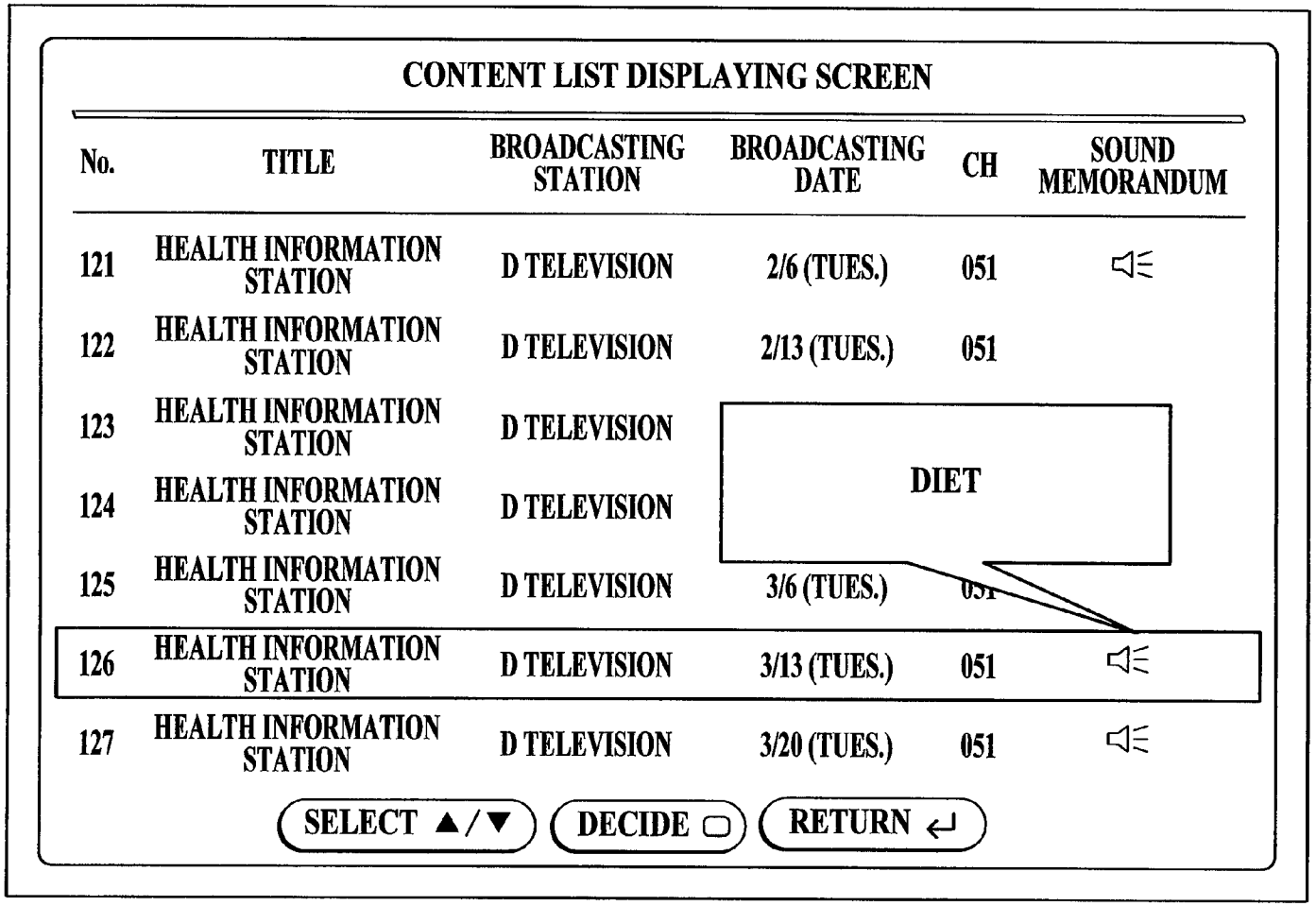
FIG. 12 is a view illustrating a content list displaying screen to display character information in the execution of a text displaying program.

FIG. 12 is a view to illustrate the content list displaying screen in which character information is displayed by the execution of the text displaying program 183*d*. For example, when a piece of content data in which an icon to indicate the existence of a sound memorandum is displayed is specified, and the sound memorandum/text displaying key 21*d* is depressed by a user in the content list displaying screen of FIG. 3, the text data based on the sound information that has been input to be associated with the content data is read from the magnetic disk 10*a* and is displayed in the displaying section 200*a* as the character information (for example, "diet") as shown in FIG. 12.

The CPU 181 functions as a text display controlling section by executing the text displaying program 183*d*.

The retrieving program 183*e* is a program to enable the CPU 181 to realize, for example, the function of retrieving the text data including a predetermined key word (predetermined word and phrase) among the text data recorded by the execution of the text recording program 183*b* based on a key operation in the key operating section 21 of the remote controller 2*a*.

The CPU 181 functions as the retrieving section by executing the retrieving program 183*e*.

The display controlling program 183*f* is a program to enable the CPU 181 to realize, for example, the function of making the displaying section 200*a* display the information pertaining to the content data associated with the text data including the predetermined word and phrase retrieved by the execution of the retrieving program 183*e*.

The CPU 181 functions as the display controlling section by executing the display controlling program 183*f*.

According to the HDD recorder 300 in the second embodiment described above, the remote controller 2*a* is provided with the key operating section 21 to receive a user's key operation. Sound information is input by the user by the execution of the sound information inputting program 27*a* by the controlling section 26, and the sound data based on the sound information input by the execution of the sound information inputting program 27*a* is transmitted to the apparatus main body 1*a* by the execution of the transmitting program 27*b*. Moreover, in the apparatus main body 1*a*, input content data is recorded on the magnetic disk 10*a* by the execution of the recording program 143*a* by the CPU 181, and the content data recorded on the magnetic disk 10*a* by the execution of the recording program 143*a* is reproduced by the execution of the reproducing program 143*b*. Moreover, the sound data transmitted from the remote controller 2*a* by the execution of the transmitting program 27*b* is received by the execution of the receiving program 143*c* by the CPU 181, and the sound data received by the execution of the receiving program 143*c* is converted into text data by the execution of the conversion-to-text program 183*a*. The text data converted by the execution of the conversion-to-text program 183*a* is recorded to be associated with a piece of content data by the execution of the text recording program 183*b*. The text data recorded by the execution of the text recording program 183*b* is converted into the predetermined sound data by the execution of the conversion-to-sound program 183*c*. The sound based on the predetermined sound data converted by the execution of the conversion-to-sound program 183*c* is output by the execution of the converted sound outputting program 143*g*.

Consequently, in the HDD recorder 300, it becomes possible to input sound information with the microphone 22 provided in the remote controller 2*a*, and to transmit the sound information to the apparatus main body 1*a* to make the apparatus main body 1*a* record the sound information in a text format. It becomes possible to input the sound information related to recorded content by a simpler method with the remote control using the remote controller 2*a*. Moreover, because the input sound information is converted into the predetermined sound to be reproduced, the usability of the HDD recorder 300 can be improved for the user.

Moreover, because the character information based on the text data recorded by the execution of the text recording program 183*b* is displayed in the displaying section 200*a* based on a key operation in the key operating section 21 by the execution of the text displaying program 183*d*, it becomes possible to display the sound information input by the user as character information. It further becomes possible to output the text data associated with the piece of content data in both the forms of a sound and the character information, and the usability of the HDD recorder 300 can be improved.

Moreover, in the apparatus main body 1*a*, because the conversion-to-sound mode of the predetermined sound data converted by the execution of the conversion-to-sound program 183*c* is selected among the plurality of conversion-to-sound modes based on a key operation in the key operating section 21 by the execution of the selecting program 143*e*, it becomes possible to reproduce sound information in a user desired sound.

Moreover, in the apparatus main body 1*a*, the text data including the predetermined word and phrase is retrieved among the pieces of text data recorded by the execution of the text recording program 183*b* based on a key operation in the key operating section 21 by the execution of the retrieving program 183*e*, and the information pertaining to the content data associated with the text data including the predetermined word and phrase, which text data having been retrieved by the execution of the retrieving program 183*e*, is displayed in the displaying section 200*a* by the execution of the display controlling program 183*f*. Consequently, the user can easily grasp the information pertaining to the content data including the predetermined word and phrase in the sound information, and can easily access the content data including the predetermined word and phrase in the sound information.

Incidentally, the scope of the present invention is not limited to the embodiments described above, but various improvements and the changes of the designs of the embodiments may be performed without departing from the spirit and the scope of the present invention.

For example, the configuration to enable a user to perform the sound input of a key word which is input in the execution of the retrieving programs 143*h* and 183*e* with the microphone 22 may be adopted.

Moreover, for example, the configuration that can record an input piece of sound information to be associated with a plurality of pieces of content data may be adopted. Moreover, the configuration that can record a plurality of pieces of sound information associated to a piece of content data may be adopted.

Moreover, for example, the configuration to enable the sound converting section 12 to convert not only the sound pitch and the voice quality of a sound, but also the rate of speech, intonation, and the like may be adopted. In that case, the configuration to enable a user to set the rate of speech may be adopted.

Moreover, sound information may not be recorded onto the magnetic disk 10*a*, on which content data is recorded, but, for example, the sound information may be recorded onto another recording medium incorporated in the apparatus main body 1 or 1*a* or connected to the apparatus main body 1 or 1*a* on the outside.

Moreover, the configuration in which the text displaying program 183*d* is included in the configuration of the first embodiment may be adopted.

Moreover, for example, the function of performing the conversion-to-text of input sound information to make the displaying section 200*a* display the converted text as character information for allowing a user to confirm the input sound information may be provided.

Moreover, the information pertaining to content data which information being displayed in the displaying section 200*a* is not limited to that shown in the embodiments described above, but any information such as a record starting time, a record ending time, genre information, a performer, the content of a program and the like may be adopted as long as the information pertains to content.

Moreover, for example, the modulation methods and the like of sound data in the remote controllers 2 and 2*a* are not limited to the FM modulation method.

Moreover, for example, the configuration in which the displaying section 200*a* displays the EPG information pertaining to the substance and the like of content at the time of inputting a sound memorandum to allow a user to input sound information while referring to the EPG information, may be adopted.

Moreover, for example, the configuration in which the reproduction of content data is also performed when the sound memorandum is reproduced may be adopted.

Moreover, for example, the inputting of sound information is not limited to the case of being performed during a time from the depressing of the sound memorandum input starting key 21*a* to the depressing of the sound memorandum input ending key 21*b*, but the configuration to perform the input of the sound information during the depressing of a predetermined key may be adopted. Moreover, the configuration to perform the input of the sound information during a predetermined time after the depressing of a predetermined key may be adopted.

Moreover, although the remote controllers 2 and 2*a* are configured to perform the transmission of sound data with the transmitting section 24 other than the remote control signal transmitting section 25, the transmission method of the sound data is not limited to this method. For example, the configuration to transmit the sound data with the remote control signal transmitting section 25 as an infrared ray may be adopted. Similarly, although the apparatus main bodies 1 and 1*a* are configured to perform the reception of sound data with the receiving section 3 other than the remote control signal receiving section 13, the reception method of the sound data is not limited to this method. For example, the configuration to receive the sound data with the remote control signal receiving section 13 as an infrared ray may be adopted. Thereby, the transmission and the reception of sound data can be realized by a low costing method using the existing configuration.

According to a first aspect of the preferred embodiments of the present invention, there is provided a recording and reproducing apparatus comprising:

an apparatus main body; and a remote controller to perform remote control of the apparatus main body, wherein the remote controller comprises:

a key operating section to receive a key operation by a user;

a sound information inputting section to allow the user to input sound information; and a transmitting section to transmit sound data to the apparatus main body, the sound data being based on the sound information input by the sound information inputting section, and the apparatus main body comprises:

a recording section to record input content data on a recording medium;

a reproducing section to reproduce the content data recorded on the recording medium by the recording section;

a receiving section to receive the sound data transmitted from the remote controller by the transmitting section;

a sound information recording section to record the sound data so as to be associated with a piece of the content data, the sound data being received by the receiving section;

a conversion-to-sound section to convert the sound data into predetermined sound data, the sound data being recorded by the sound information recording section;

a converted sound outputting section to output a sound based on the predetermined sound data converted by the conversion-to-sound section;

a selecting section to select a conversion-to-sound mode of the predetermined sound data, among a plurality of conversion-to-sound modes based on the key operation in the key operating section, the predetermined sound data being converted by the conversion-to-sound section;

a retrieving section to retrieve sound data which includes a predetermined word and phrase among the sound data based on the key operation in the key operating section, the sound data being recorded by the sound information recording section; and a display controlling section to make a displaying section display information pertaining to the content data associated with the sound data which includes the predetermined word and phrase, the sound data being retrieved by the retrieving section.

According to a first aspect of the present invention, a remote controller includes a key operating section to receive a key operation by a user. The user inputs sound information with a sound information inputting section. A transmitting section transmits the sound data based on the sound information input with the sound information inputting section to the apparatus main body. Moreover, in the apparatus main body, input content data is recorded onto a recording medium with a recording section, and the content data recorded on the recording medium by the recording section is reproduced by a reproducing section. The sound data transmitted from the remote controller by the transmitting section is received by a receiving section, and the sound data received by the receiving section is recorded by a sound information recording section to be associated with a piece of content data. The sound data recorded by the sound information recording section is converted into predetermined sound data by a conversion-to-sound section, and the sound based on the predetermined sound data, which sound having been converted by the conversion-to-sound section, is output by a converted sound outputting section. A conversion-to-sound mode of the predetermined sound data converted by the conversion-to-sound section is selected among a plurality of conversion-to-sound modes on a basis of a key operation in the key operating section by a selecting section. Sound data to include a predetermined word and phrase is retrieved among the sound data recorded by the sound information recording section on a basis of a key operation in the key operating section by a retrieving section, and the information pertaining to the content data associated with the sound data to include the predetermined word and phrase, which sound data having been retrieved by the retrieving section, is displayed in the displaying section by a display controlling section.

Consequently, in the recording and reproducing apparatus, it becomes possible to input the sound information with the sound information inputting section provided in the remote controller, and to transmit the sound information to the apparatus main body to make the apparatus main body record the transmitted sound information. Thereby, it becomes possible to input the sound information related to recorded content by a simpler method by the remote control using the remote controller. Moreover, because the sound information input by the user is converted to the sound desired by the user to be reproduced, the usability of the recording and reproducing apparatus for the user can be improved. Furthermore, the user can easily grasp the information pertaining to the content data including the predetermined word and phrase in its sound information, and is led to be able to easily access the content data including the predetermined word and phrase in the sound information.

According to another aspect of the preferred embodiments of the present invention, there is provided a recording and reproducing apparatus comprising:

an apparatus main body; and a remote controller to perform remote control of the apparatus main body, wherein the remote controller comprises:

a key operating section to receive a key operation by a user;

a sound information inputting section to allow the user to input sound information; and a transmitting section to transmit sound data to the apparatus main body, the sound data being based on the sound information input by the sound information inputting section, and the apparatus main body comprises:

a recording section to record input content data on a recording medium;

a reproducing section to reproduce the content data recorded on the recording medium by the recording section;

a receiving section to receive the sound data transmitted from the remote controller by the transmitting section;

a sound information recording section to record the sound data so as to be associated with a piece of the content data, the sound data being received by the receiving section; and a sound information outputting section to reproduce the sound data recorded by the sound information recording section, to output the reproduced sound data.

According to a second aspect of the invention, a remote controller includes a key operating section to receive a key operation by a user. Sound information is input by the user with a sound information inputting section. The sound data based on the sound information input with the sound information inputting section is transmitted to the apparatus main body by a transmitting section. In the apparatus main body, input content data is recorded onto a recording medium by a recording section. The content data recorded on the recording medium by the recording section is reproduced by a reproducing section. The sound data transmitted from the remote controller by the transmitting section is received by a receiving section. The sound data received by the receiving section is recorded by a sound information recording section to be associated with a piece of content data. The sound data recorded by the sound information recording section is reproduced to be output by a sound information outputting section.

Consequently, in the recording and reproducing apparatus, it becomes possible to input the sound information with the sound information inputting section provided in the remote controller, and to transmit the sound information to the apparatus main body to make the apparatus main body record the sound information. By the remote control using the remote controller, it becomes possible to input the sound information related to recorded content by a simpler method.

According to still another aspect of the preferred embodiments of the present invention, there is provided a recording and reproducing apparatus comprising:

an apparatus main body; and a remote controller to perform remote control of the apparatus main body, wherein the remote controller comprises:

a key operating section to receive a key operation by a user;

a sound information inputting section to allow the user to input sound information; and a transmitting section to transmit sound data to the apparatus main body, the sound data being based on the sound information input by the sound information inputting section, and the apparatus main body comprises:

a recording section to record input content data on a recording medium;

a reproducing section to reproduce the content data recorded on the recording medium by the recording section;

a receiving section to receive the sound data transmitted from the remote controller by the transmitting section;

a sound information recording section to record the sound data so as to be associated with a piece of the content data, the sound data being received by the receiving section;

a conversion-to-sound section to convert the sound data into predetermined sound data, the sound data being recorded by the sound information recording section; and a converted sound outputting section to output a sound based on the predetermined sound data converted by the conversion-to-sound section.

According to a third aspect of the invention, a remote controller includes a key operating section to receive a key operation by a user. Sound information is input by the user with a sound information inputting section. The sound data based on the sound information input with the sound information inputting section is transmitted to the apparatus main body by a transmitting section. Moreover, in the apparatus main body, input content data is recorded onto a recording medium by a recording section. The content data recorded on the recording medium by the recording section is reproduced by a reproducing section. The sound data transmitted from the remote controller by the transmitting section is received by a receiving section. The sound data received by the receiving section is recorded by a sound information recording section to be associated with a piece of content data. The sound data recorded by the sound information recording section is converted into predetermined sound data by a conversion-to-sound section. The sound based on the predetermined sound data converted by the conversion-to-sound section is output by a converted sound outputting section.

Consequently, in the recording and reproducing apparatus, it becomes possible to input sound information with the sound information inputting section provided in the remote controller, and to transmit the sound information to the apparatus main body to make the apparatus main body record the sound information. It then becomes possible to input the sound information related to recorded content by a simpler method by the remote control using the remote controller. Moreover, because the sound information input by the user is converted to the predetermined sound to be reproduced, the usability of the recording and reproducing apparatus can be improved for the user.

Preferably, the apparatus main body further comprises:

a retrieving section to retrieve sound data which includes a predetermined word and phrase among the sound data based on the key operation in the key operating section, the sound data being recorded by the sound information recording section; and a display controlling section to make a displaying section display information pertaining to the content data associated with the sound data which includes the predetermined word and phrase, the sound data being retrieved by the retrieving section.

According to a fourth aspect of the invention, in the recording and reproducing apparatus of the second or the third aspect, in the apparatus main body, the sound data including a predetermined word and phrase is retrieved among the pieces of sound data recorded by the sound information recording section on a basis of a key operation in the key operating section by a retrieving section. The information pertaining to the content data associated with the sound data including the predetermined word and phrase, which sound data having been retrieved by the retrieving section, is displayed in the displaying section by a display controlling section.

Consequently, the user can easily grasp the information pertaining to the content data including the predetermined word and phrase in the sound information, and the user becomes able to easily access the content data including the predetermined word and phrase in the sound information.

According to still another aspect of the preferred embodiments of the present invention, there is provided a recording and reproducing apparatus comprising:

an apparatus main body; and a remote controller to perform remote control of the apparatus main body, wherein the remote controller comprises:

a key operating section to receive a key operation by a user;

a sound information inputting section to allow the user to input sound information; and a transmitting section to transmit sound data to the apparatus main body, the sound data being based on the sound information input by the sound information inputting section, and the apparatus main body comprises:

a recording section to record input content data on a recording medium;

a reproducing section to reproduce the content data recorded on the recording medium by the recording section;

a receiving section to receive the sound data transmitted from the remote controller by the transmitting section;

a conversion-to-text section to convert the sound data into text data, the sound data being received by the receiving section;

a text recording section to record the text data so as to be associated with a piece of the content data, the text data being converted by the conversion-to-text section;

a conversion-to-sound section to convert the text data into predetermined sound data, the text data being recorded by the text recording section; and a converted sound outputting section to output a sound based on the predetermined sound data converted by the conversion-to-sound section.

According to a fifth aspect of the invention, a remote controller includes a key operating section to receive a key operation by a user. Sound information is input by a user with a sound information inputting section. Sound data based on the sound information input with the sound information inputting section is transmitted to the apparatus main body by a transmitting section. Moreover, in the apparatus main body, input content data is recorded onto a recording medium by a recording section. The content data recorded on the recording medium by the recording section is reproduced by a reproducing section. The sound data transmitted from the remote controller by the transmitting section is received by a receiving section. The sound data received by the receiving section is converted into text data by a conversion-to-text section. The text data converted by the conversion-to-text section is recorded to be associated with a piece of content data by a text recording section. The text data recorded by the text recording section is converted into predetermined sound data by a conversion-to-sound section. The sound based on the predetermined sound data converted by the conversion-to-sound section is output by a converted sound outputting section.

Consequently, in the recording and reproducing apparatus, it becomes possible to input sound information with the sound information inputting section provided in the remote controller, and to transmit the sound information to the apparatus main body to make the apparatus main body record the transmitted sound information in a text format. Then, it becomes possible to input the sound information related to recorded content by a simpler method by the remote control using the remote controller. Moreover, because the sound information input by the user is converted into the predetermined sound to be reproduced, the usability of the recording and reproducing apparatus can be improved for the user.

Preferably, the apparatus main body further comprises a text display controlling section to make a displaying section display character information based on the text data, based on the key operation in the key operating section, the text data being recorded by the text recording section.

According to a sixth aspect of the invention, the advantages of the fifth aspect can be naturally obtained, and the character information based on the text data recorded by the text recording section is displayed in the displaying section on a basis of a key operation in the key operating section by a text display controlling section in the apparatus main body.

Consequently, it becomes possible to display the sound information input by a user as the character information, and the usability of the recording and reproducing apparatus can be further improved.

Preferably, the apparatus main body further comprises:

a retrieving section to retrieve text data which includes a predetermined word and phrase among the text data based on the key operation in the key operating section, the text data being recorded by the text recording section; and a display controlling section to make a displaying section display information pertaining to content data associated with the text data which includes the predetermined word and phrase, the text data being retrieved by the retrieving section.

According to a seventh aspect of the invention, the advantages of the fifth or sixth aspect can be naturally obtained, and the text data including a predetermined word and phrase is retrieved among the text data recorded by the text recording section on a basis of the key operation in the key operating section by a retrieving section in the apparatus main body. Moreover, the information pertaining to the content data associated with the text data including the predetermined word and phrase, which text data having been retrieved by the retrieving section, is displayed in the displaying section by a display controlling section.

Consequently, the user can easily grasp the information pertaining to the content data including the predetermined word and phrase in sound information, and it becomes possible for the user to easily access the content data including the predetermined word and phrase in the sound information.

Preferably, the apparatus main body further comprises a selecting section to select a conversion-to-sound mode of the predetermined sound data, among a plurality of conversion-to-sound modes based on the key operation in the key operating section, the predetermined sound data being converted by the conversion-to-sound section.

According to an eighth aspect of the invention, the advantages of any one of the third to the seventh aspects can be naturally obtained, and the conversion-to-sound mode of the predetermined sound data converted by the conversion-to-sound section is selected among a plurality of conversion-to-sound modes on a basis of the key operation in the key operating section by a selecting section in the apparatus main body.

Consequently, sound information can be reproduced by a sound desired by the user.

The entire disclosure of Japanese Patent Application No. 2007-106351 filed on Apr. 13, 2007 including description, claims, drawings and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A recording and reproducing apparatus comprising:

an apparatus main body; and a remote controller to perform remote control of the apparatus main body, wherein the remote controller comprises:

a key operating section to receive a key operation by a user;

a sound information inputting section to allow the user to input sound information; and a transmitting section to transmit sound data to the apparatus main body, the sound data being based on the sound information input by the sound information inputting section, and the apparatus main body comprises:

a recording section to record input content data on a recording medium;

a reproducing section to reproduce the content data recorded on the recording medium by the recording section;

a receiving section to receive the sound data transmitted from the remote controller by the transmitting section;

a sound information recording section to record the sound data so as to be associated with a piece of the content data, the sound data being received by the receiving section;

a conversion-to-sound section to convert the sound data into predetermined sound data, the sound data being recorded by the sound information recording section;

a converted sound outputting section to output a sound based on the predetermined sound data converted by the conversion-to-sound section, the sound being associated with the piece of the content data by a sound memorandum that is selectable by pressing a sound memorandum reproducing key on the remote controller to output the sound independently from the content data;

a selecting section to select a conversion-to-sound mode of the predetermined sound data, among a plurality of conversion-to-sound modes based on the key operation in the key operating section, the predetermined sound data being converted by the conversion-to-sound section;

a retrieving section to retrieve sound data which includes a predetermined word and phrase among the sound data based on the key operation in the key operating section, the sound data being recorded by the sound information recording section; and a display controlling section to make a displaying section display information pertaining to the content data associated with the sound data which includes the predetermined word and phrase, the sound data being retrieved by the retrieving section.

2. The recording and reproducing apparatus according to claim 1, wherein the conversion-to-sound section comprises:

a pitch shifting unit that converts a pitch of the sound data by changing a pitch frequency of the sound data; and a formant shifting unit that converts a voice quality of the sound data by changing formant frequency of the sound data.

3. A recording and reproducing apparatus comprising:

an apparatus main body; and a remote controller to perform remote control of the apparatus main body, wherein the remote controller comprises:

a key operating section to receive a key operation by a user;

a sound information inputting section to allow the user to input sound information; and a transmitting section to transmit sound data to the apparatus main body, the sound data being based on the sound information input by the sound information inputting section, and the apparatus main body comprises:

a recording section to record input content data on a recording medium;

a reproducing section to reproduce the content data recorded on the recording medium by the recording section;

a receiving section to receive the sound data transmitted from the remote controller by the transmitting section; and a sound information recording section to record the sound data so as to be associated with a piece of the content data, the sound data being received by the receiving section; and a sound information outputting section to reproduce the sound data recorded by the sound information recording section, to output the reproduced sound data, the sound data being associated with the piece of the content data by a sound memorandum that is selectable by pressing a sound memorandum reproducing key on the remote controller to output the sound independently from the content data.

4. The recording and reproducing apparatus according to claim 3, wherein the apparatus main body further comprises:

a retrieving section to retrieve sound data which includes a predetermined word and phrase among the sound data based on the key operation in the key operating section, the sound data being recorded by the sound information recording section; and a display controlling section to make a displaying section display information pertaining to the content data associated with the sound data which includes the predetermined word and phrase, the sound data being retrieved by the retrieving section.

5. A recording and reproducing apparatus comprising:

an apparatus main body; and a remote controller to perform remote control of the apparatus main body, wherein the remote controller comprises:

a key operating section to receive a key operation by a user;

a sound information inputting section to allow the user to input sound information; and a transmitting section to transmit sound data to the apparatus main body, the sound data being based on the sound information input by the sound information inputting section, and the apparatus main body comprises:

a recording section to record input content data on a recording medium;

a reproducing section to reproduce the content data recorded on the recording medium by the recording section;

a receiving section to receive the sound data transmitted from the remote controller by the transmitting section;

a sound information recording section to record the sound data so as to be associated with a piece of the content data, the sound data being received by the receiving section;

a conversion-to-sound section to convert the sound data into predetermined sound data, the sound data being recorded by the sound information recording section; and a converted sound outputting section to output a sound based on the predetermined sound data converted by the conversion-to-sound section, the sound being associated with the content data by a sound memorandum that is selectable by pressing a sound memorandum reproducing key on the remote controller to output the sound independently from the content data.

6. The recording and reproducing apparatus according to claim 5, wherein the apparatus main body further comprises a selecting section to select a conversion-to-sound mode of the predetermined sound data, among a plurality of conversion-to-sound modes based on the key operation in the key operating section, the predetermined sound data being converted by the conversion-to-sound section.

7. The recording and reproducing apparatus according to claim 5, wherein the conversion-to-sound section comprises:

a pitch shifting unit that converts a pitch of the sound data by changing a pitch frequency of the sound data; and a formant shifting unit that converts a voice quality of the sound data by changing formant frequency of the sound data.

8. A recording and reproducing apparatus comprising:

an apparatus main body; and a remote controller to perform remote control of the apparatus main body, wherein the remote controller comprises:

a key operating section to receive a key operation by a user;

a sound information inputting section to allow the user to input sound information; and a transmitting section to transmit sound data to the apparatus main body, the sound data being based on the sound information input by the sound information inputting section, and the apparatus main body comprises:

a recording section to record input content data on a recording medium;

a reproducing section to reproduce the content data recorded on the recording medium by the recording section;

a receiving section to receive the sound data transmitted from the remote controller by the transmitting section;

a conversion-to-text section to convert the sound data into text data, the sound data being received by the receiving section;

a text recording section to record the text data so as to be associated with a piece of the content data, the text data being converted by the conversion-to-text section;

a conversion-to-sound section to convert the text data into predetermined sound data, the text data being recorded by the text recording section; and a converted sound outputting section to output a sound based on the predetermined sound data converted by the conversion-to-sound section, the sound being associated with the piece of the content data by a sound memorandum that is selectable by pressing a sound memorandum reproducing key on the remote controller to output the sound independently from the content data.

9. The recording and reproducing apparatus according to claim 8, wherein the apparatus main body further comprises a text display controlling section to make a displaying section display character information based on the text data, based on the key operation in the key operating section, the text data being recorded by the text recording section.

10. The recording and reproducing apparatus according to claim 8, wherein the apparatus main body further comprises:

a retrieving section to retrieve text data which includes a predetermined word and phrase among the text data based on the key operation in the key operating section, the text data being recorded by the text recording section; and a display controlling section to make a displaying section display information pertaining to content data associated with the text data which includes the predetermined word and phrase, the text data being retrieved by the retrieving section.

11. The recording and reproducing apparatus according to claim 8, wherein the conversion-to-sound section comprises:

a pitch shifting unit that converts a pitch of the sound data by changing a pitch frequency of the sound data; and a formant shifting unit that converts a voice quality of the sound data by changing formant frequency of the sound data.

* * * * *